US006916188B2

(12) United States Patent
Lang et al.

(10) Patent No.: US 6,916,188 B2
(45) Date of Patent: Jul. 12, 2005

(54) DIFFERENTIAL SIGNAL CONNECTORS WITH ESD PROTECTION

(75) Inventors: Harold Keith Lang, Fox River Grove, IL (US); Kent E. Regnier, Lombard, IL (US); Emanuel G. Banakis, Naperville, IL (US); David E. Dunham, Aurora, IL (US); Robert A. Owsley, Lisle, IL (US)

(73) Assignee: Molex Incorporated, Lisle, IL (US)

( * ) Notice: Subject to any disclaimer, the term of this patent is extended or adjusted under 35 U.S.C. 154(b) by 62 days.

(21) Appl. No.: 10/435,691

(22) Filed: May 6, 2003

(65) Prior Publication Data

US 2004/0087196 A1 May 6, 2004

Related U.S. Application Data

(60) Provisional application No. 60/454,403, filed on Mar. 13, 2003, and provisional application No. 60/378,319, filed on May 6, 2002.

(51) Int. Cl.[7] ..... H01R 13/648

(52) U.S. Cl. ..... 439/101; 439/609; 439/924.1; 439/931; 439/181

(58) Field of Search ..... 439/101, 108, 439/609, 607, 924.1, 931, 181

(56) References Cited

U.S. PATENT DOCUMENTS

| | | | | | |
|---|---|---|---|---|---|
| 4,867,690 | A | * | 9/1989 | Thumma | 439/79 |
| 5,228,871 | A | * | 7/1993 | Goodman | 439/607 |
| 5,344,341 | A | * | 9/1994 | Yoshino | 439/607 |
| 5,354,219 | A | | 10/1994 | Wanjura | |
| 5,403,196 | A | * | 4/1995 | Northey et al. | 439/108 |
| 5,509,823 | A | * | 4/1996 | Harting et al. | 439/607 |
| 5,718,606 | A | * | 2/1998 | Rigby et al. | 439/608 |
| 5,743,765 | A | * | 4/1998 | Andrews et al. | 439/608 |
| 5,795,191 | A | | 8/1998 | Preputnick et al. | |
| 5,938,450 | A | * | 8/1999 | Nagafuji | 439/63 |
| 5,943,770 | A | | 8/1999 | Thenaisle et al. | |
| 6,347,962 | B1 | | 2/2002 | Kline | |
| 6,488,533 | B1 | * | 12/2002 | Thompson et al. | 439/509 |
| 6,491,545 | B1 | * | 12/2002 | Spiegel et al. | 439/579 |
| 6,544,072 | B2 | | 4/2003 | Olson | |
| 6,699,049 | B1 | * | 3/2004 | Wu | 439/79 |
| 6,702,590 | B2 | * | 3/2004 | Zaderej et al. | 439/74 |
| 6,848,917 | B2 | * | 2/2005 | Lang et al. | 439/79 |
| 2001/0048995 | A1 | | 12/2001 | Billman et al. | |
| 2002/0048995 | A1 | | 4/2002 | Shindo | |
| 2002/0142629 | A1 | | 10/2002 | Zaderej et al. | |
| 2004/0018757 | A1 | | 1/2004 | Lang et al. | |
| 2004/0038590 | A1 | | 2/2004 | Lang et al. | |
| 2004/0072470 | A1 | | 4/2004 | Lang et al. | |

FOREIGN PATENT DOCUMENTS

| | | |
|---|---|---|
| EP | 0563691 A1 | 9/1993 |
| EP | 1111730 A2 | 6/2001 |

OTHER PUBLICATIONS

U.S. Appl. No. 10/435,697, filed May 6, 2003, presently pending, "High–Speed differential signal connector particularly suitable for docking applications".

* cited by examiner

*Primary Examiner*—Gary Paumen
(74) *Attorney, Agent, or Firm*—Thomas D. Paulius

(57) ABSTRACT

A connector assembly is provided with opposing and interengageable first and second connector components. Each of the two components preferably includes upper and lower housing formed from an insulative material coated with electrically-conductive material, with cavities formed therein that receive terminal assemblies. The upper and lower housings are formed with internal cavities that extend in orthogonal directions. Each cavity contains a terminal assembly of either plug or receptacle structure and may further include either a plurality of power terminals or differential signal terminals. The terminals have contact portions, tail portions and interconnecting portions that are partially encapsulated by an insulative outer shell. In assembling the first and second components, multiple ground connections are made in sequence before any signal or power supply connections are made. In disassembling the components, signals and power supply connections are broken first, then the ground connections are broken in a sequence that is the reverse of what was made during assembly.

13 Claims, 37 Drawing Sheets

DIFFERENTIAL SIGNAL CONNECTORS WITH ESD PROTECTION

REFERENCE TO RELATED APPLICATIONS

This application claims priority from U.S. Provisional Patent Applications Ser. No. 60/378,319, filed May 6, 2002 and Ser. No. 60/454,403, filed Mar. 13, 2003.

BACKGROUND OF THE INVENTION

The present invention relates generally to high-speed connectors, and more particularly, to connectors suitable for use in high-speed data transmission with interstitial ground arrangements between groups of differential signal pairs.

In the field of data transmission, the computer and server industries attempt to constantly increase the speed at which their products can transmit and receive data. Most specifications for these type components now call for minimum speeds of 1 Gigabit per second. Such connectors typically utilize differential signaling, meaning that the signal terminals are arranged in pairs of terminals so as to take advantage of the benefits of differential signaling.

However, with the use of differential signaling certain problems arise. A designer needs to bring multiple grounds into the connector in order to ensure signal isolation. A typical approach to providing the grounds in such a connector would be to utilize a single ground in each differential signal pair. This approach may unduly increase the size of the connector and render it ineffective for its intended application. Also, with the use of separate ground terminals for each differential pair, the total number of circuits that can be supported by the connector depends on the number of terminals the connector is designed to support. Hence, if a connector requires ground terminals for each differential pair, the connector will be longer in size and possibly increase the size of the electronic components with which it is used to the extent where it is undesirable to use from a circuit board real estate perspective Typically, there is a gap in the interface between the connector and the associated circuit board. It is well-known that such gaps can cause undesirable discontinuities in impedance values at higher frequencies that are used in data transmission.

Additionally, some applications require a differential signal connector that can interconnect a plurality of differential signal circuits on two printed circuit boards that are spaced apart in generally parallel planes, that is, one circuit board is positioned above or below the other circuit board. In such applications, the differential signal connector is interposed between the two circuit boards and the electrical connections therebetween may cause undesired levels of stress to be applied to at least some of the terminals of the connector or to the circuit boards at the connector-circuit board interface.

A need therefore exists for a high speed connector that accommodates differential signals that minimizes impedance discontinuities throughout the connector and at the connector-circuit board interface.

A need also exists for providing a plurality of differential signal pairs through the connector, and at the same time, providing a plurality of ground terminals that separate the differential signal pairs into discrete groups of signal pairs, and which also provide an affinity across the connector to circuit board interface for the differential signal pairs to maintain relatively constant impedance through the connector, especially at the connector to circuit board interface.

A need also exists for a high speed connector of the interposer type that accommodates differential signals. There is also a need for such a connector in which the differential terminal pairs have compliant tail portions to reduce stresses on the terminal pairs and on the circuit boards at the connector-circuit board interface.

The present invention provides connectors of the "docking" and "interposer" styles and terminal assemblies used in such connectors that overcome the aforementioned disadvantages. The present invention provides an interposer type connector for interconnecting a plurality of differential signal circuits between spaced apart circuit boards that overcomes the aforementioned disadvantages.

SUMMARY OF THE INVENTION

Accordingly, it is a general object of present invention to provide a high-speed connector assembly for use in transmitting differential signals between two electronic components.

Another object of the present invention is to provide such connector assemblies in the docking and interposer styles for use with such differential signal applications.

A further object of the present invention is to provide a differential signal connector assembly that uses a circuit board interface with a plurality of interstitial ground terminals that separate differential signal pairs of the connector into discrete groups and which also to provide an affinity to ground for adjacently located differential signal pairs to control the impedance across the connector to circuit board interface at a desired value or range of such values.

A still further object is to provide a differential signal connector assembly for connecting two circuit boards together, the connector assembly including interengaging plug and receptacle connector components that each house a plurality of terminal assemblies, the terminal assemblies being received within cavities of the plug and receptacle connector components, and the connector assembly utilizing a plurality of ground terminals located at interstitial positions between groups of differential signal pairs at the connector to circuit board interface.

Yet another object of the present invention is to provide the plug and receptacle connector components with conductive exterior surfaces that serve as associated grounds to the differential signal and terminal assemblies supported by the connector components and which are electrically coupled to the ground terminals.

Still another object of the present invention is to provide terminal assemblies for use in a differential signal connector of the interposer type that interconnect differential signal circuits on two spaced-apart circuit boards, with each terminal assembly supporting a plurality of differential signal pairs within passages of a connector housing.

Yet another object of the present invention is to provide an improved connector for use with the transmission of differential signals wherein the connector has a conductive housing that houses a plurality of sets of differential signal terminal pairs and wherein the connector housing includes a plurality of ground terminals located at interstitial positions on the connector housing and between groups of differential signal pairs at the connector to circuit board interface.

A further object of the present invention is to provide a connector for use in differential signal applications, the connector including an insulative housing having a plurality of internal cavities, a plurality of terminal assemblies received within the cavities, each of the terminal assemblies including a plurality of conductive terminals defining a plurality of differential pairs of signal terminals, the terminals of the terminal assemblies including distinct contact, tail and interconnecting terminal portions, the terminal contact portions being at least partially surrounded by portions of the connector components, the exterior surfaces of these portions being coated with a conductive material that is connected to a ground circuit when the connector component is mounted to a circuit board so that the terminal differential pair contact portions have associated ground portions encompassing them.

Another object of the present invention is to provide an interposer type connector assembly for differential signal applications between spaced-apart circuit boards that has compliant tail portions on the differential signal pairs.

Still another object of the present invention is to provide terminal assemblies for a differential signal connector of the interposer type that may be easily and inexpensively manufactured.

Yet another object of the present invention is to provide terminal assemblies of the differential signal type that are formed as complementary halves, with engagement means on each half for engaging the two halves into a unitary terminal assembly.

A still further object of the present invention is to provide sets of terminals having varying lengths, with at least one set of the terminals having shorter contact lengths than the other terminals so as to provide a means for determining full mating of the connectors of the connector assembly of the invention when the shorter length terminals are mated to their opposing terminals.

Yet still another object of the present invention is to provide interengageable plug and receptacle connectors with two-part housings, each including upper and lower housings, the upper and lower housings having a plurality of spaced-apart cavities formed therein, the cavities in the lower housings extending in one direction and the cavities in the upper housings extending in a second direction different than the first direction so that when mated together, the plug and receptacle housings have a plurality of internal L-shaped cavities, each of which receives a terminal assembly therein, the terminal assemblies having a plurality of differential signal pairs disposed therein, the terminal assemblies including corresponding engaging plug and receptacle terminal assemblies.

Yet another object of the present invention is to provide a high speed connector for interconnecting two electronic components together, such as two circuit boards, the connector having a interposer configuration with a plurality of differential signal terminal pairs supported by the connector housing, the terminal pairs having compliant pins portions as their contact and tail portions.

A still further object of the present invention is to provide terminal assemblies of identical shape for insertion into passages of the connector housing, the terminal assemblies each supporting a plurality of differential signal terminals, the terminals having varying lengths, with some of the terminals having a shorter length than the other terminals so as to provide a means for determining full mating of the connectors of the connector assembly when the shorter terminals are mated to their opposing terminals.

Still another object of the present invention is to provide a connector assembly that utilizes interengaging male and female connector components for transferring differential signals between two electronic components, the male and female connector components having a plurality of contacting elements that engage each other in a specific mating sequence so that a plurality of ground elements contact each other as the two connector components are mated together to ensure ground contact during mating and separating of the connector components.

These and other objects of the present invention are accomplished by the structure of the connector assembly. In one principal aspect of the present invention and as exemplified by one embodiment of the invention, a connector assembly is provided with opposing and interengageable first and second connector components. Each of the two components preferably includes upper and lower housing formed from an insulative material, with cavities formed therein that receive terminal assemblies.

The upper and lower housings are formed with internal cavities that extend in different directions. These cavities are aligned together when the upper and lower housings are assembled together to define a plurality of L-shaped internal cavities in the first and second connector components.

In another important aspect of the present invention, the upper and lower housings are each coated on the exterior surfaces with a conductive coating which may be accomplished by plating the same with a conductive material. Preferably, all of the surfaces of the housings are plated and are connected to one or more ground circuits disposed on one or more circuit boards. The lower housings may include slots disposed in their portion faces that receive separately formed terminals in order to provide a series of ground connection points and to provide redundancy of connection.

In another important aspect of the present invention, the connector components are formed as respective interengaging male and female or plug and receptacle connectors, each with a plurality of cavities. Each cavity contains a terminal assembly of either plug or receptacle structure, which assembly may further include either a plurality of power terminals or differential signal terminals. In either instance, the terminals have contact portions, tail portions and interconnecting portions that are partially encapsulated by an insulative outer shell. The shell forms a support framework in the form of a skeleton and two half-frames are combined together to form a single terminal assembly containing at least two different, differntial signal terminal pairs.

The terminal assemblies are all identical so that they may be inserted into any of the cavities of the housings. The plug-style terminal assemblies are typically held in the receptacle connector housing, while the receptacle-style terminal assemblies are typically held in the plug connector housing. The plug-style assemblies have contact blade portions in which terminals are embedded and exposed, while the receptacle-style assemblies have contact blade portions that extend out from the insulative body portion and which are spread apart from each other so that when the two connectors are mated together the receptacle-style contact blades extend into cavities of the receptacle connector and make contact with the plug-style assembly contact blades.

Both connector housings are further provided with contact blades formed as parts of the housing and which make contact with each other when the connector housings are mated together.

In another principal aspect of the present invention and as exemplified by two different embodiments of the invention, connector assemblies of either the docking-type or the interposer-type for interconnecting a plurality of differential signal pairs between circuit boards, are provided with interstitial ground terminals disposed between certain of the differential signal pairs at the connector to circuit board interface. This interstitial ground arrangement subdivides the differential signal pairs in the connector into discrete groups, and further provides an affinity for the differential signal pairs to ground at the connector to circuit board interface to better maintain a low impedance for the high frequency differential signals thereacross.

The connectors of the docking style preferably include upper and lower housings formed from an insulative material, with cavities formed therein that receive terminal assemblies. The upper and lower housings are formed with internal cavities that extend in different directions. These cavities are aligned together when the upper and lower housings are assembled together to define a plurality of L-shaped internal cavities in the first and second connector components.

Preferably, the upper and lower housings are each coated on the exterior surfaces with a conductive coating which may be accomplished by plating the same with a conductive material. Preferably, all of the surfaces of the housings are plated and are connected to one or more ground circuits disposed on one or more circuit boards. The lower housings may include slots, or recesses, disposed in their mounting faces that receive separately formed terminals in order to provide a plurality of ground connection points and to provide redundancy of ground connection.

The connector components are formed as respective interengaging male and female (or plug and receptacle connectors), each having a plurality of cavities formed therein. Each cavity contains a terminal assembly of either a plug or receptacle structure, which assembly may further include either a plurality of power terminals or differential signal terminals. In either instance, the terminals typically include contact portions, tail portions and interconnecting portions that are partially encapsulated by an insulative outer shell. The shell forms a block and two such blocks are combined together to form a terminal assembly. The blocks are identical in shape other than for an engagement means that serves to hold two of the blocks together as a single assembly.

The connector of the interposer style preferably has an elongated and insulative housing with a plurality of cavities defined in the housing between opposite sides thereof. The housing may have attachment or fastening means disposed at the opposite ends thereof. On one side of the housing, the cavities are elongated and disposed transversely to a longitudinal axis of the housing, and preferably the centerline of the housing, and are separated from each other by interior walls that also extend in the same transverse of direction. On an opposite side of the connector, a plurality of smaller cavities are defined in the housing and communicate with the elongated cavities to provide a plurality of individual passages completely through the housing between the opposite sides. These passages may be characterized as being generally "E" shaped. Preferably, all of the surfaces of the housing are coated with a conductive material, including in the passages through the housing.

The terminal assemblies are all virtually identical so that they may be inserted into any of the cavities of the housings, thereby impacting a measure of modularity to the connectors. The plug-style wafers are typically held in the receptacle connector housing, while the receptacle-style wafers are typically held in the plug connector housing. The plug-style wafers have contact blade portions in which terminals are embedded and exposed, while the receptacle-style wafers have contact blade portions that extend out from the insulative body portion and which are spread apart from each other, so that when the two connectors are mated together the receptacle-style contact blades extend into cavities of the receptacle connector and make contact with the plug-style wafer contact blades.

In either the docking or interposer connector styles for interconnecting a plurality of differential signals between circuits on circuit boards, the interstitial ground arrangement preferably includes a plurality of ground terminals located at interstitial positions between small groups of differential signal pairs. For example, terminal lugs having a plurality of ground terminals may be inserted into slots defined in the conductive walls of the connector that separate the channels in which the differential signal pairs are located. Thus, each ground terminal will be adjacently located to a least one differential signal pair. In yet another example, terminal lugs having two ground terminals may be disposed adjacently to three differential signal pairs, with the terminal lugs being located generally equidistant from the differential signal pairs.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which.

DETAILED DESCRIPTION OF THE PREFERRED EMBODIMENTS

Connector Housing Structure

Figure 25A:
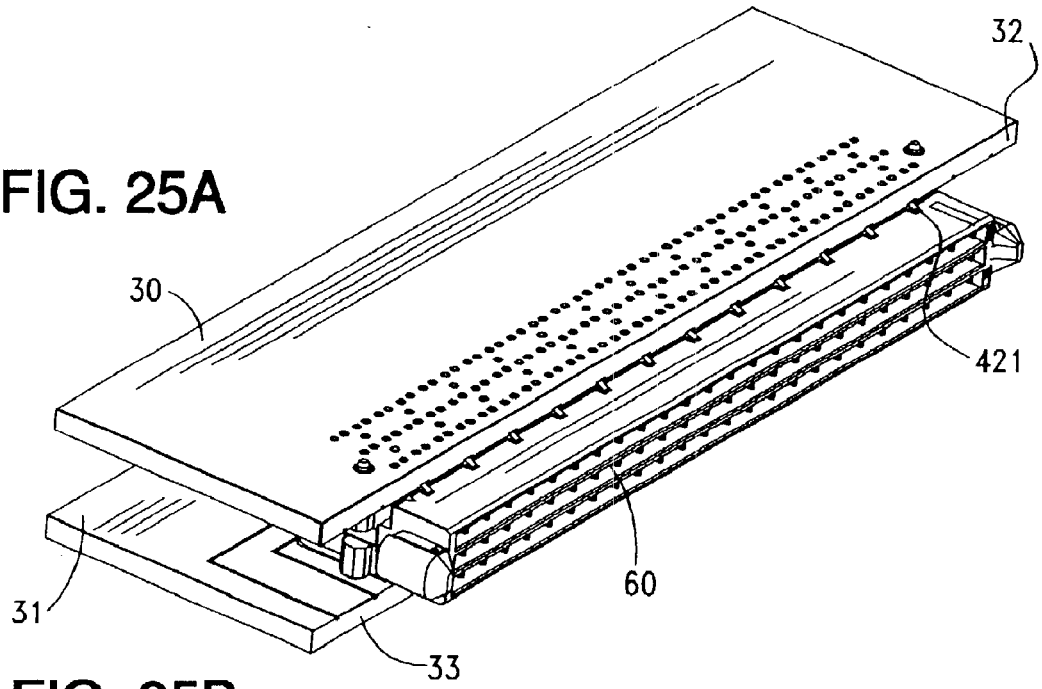
FIG. 25A is a perspective view of the plug connector component mounted to either of two circuit boards.
Figure 25B:
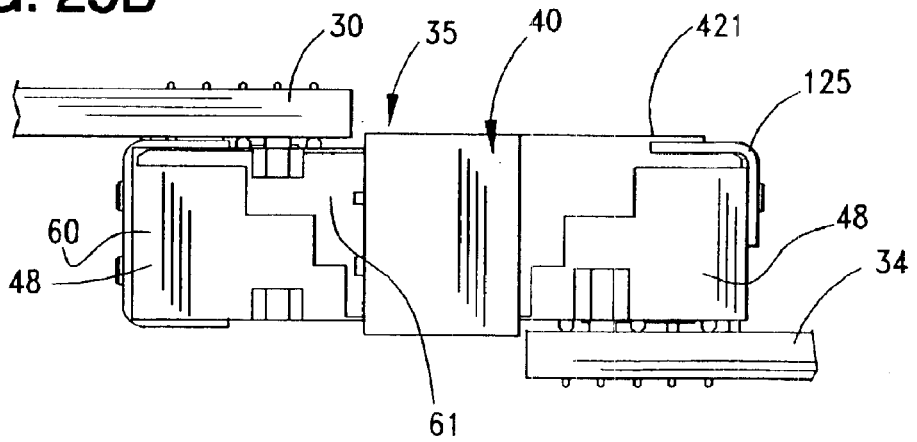
FIG. 25B is a side elevational view of a plug and a receptacle connector component mounted to circuit boards mated together, illustrating how with the connector assemblies of the present invention, either a standard mating (with the circuit boards arranged in generally the same plane) or an inverted mating (with the circuit boards arranged in two different, but parallel planes)
Figure 25C:
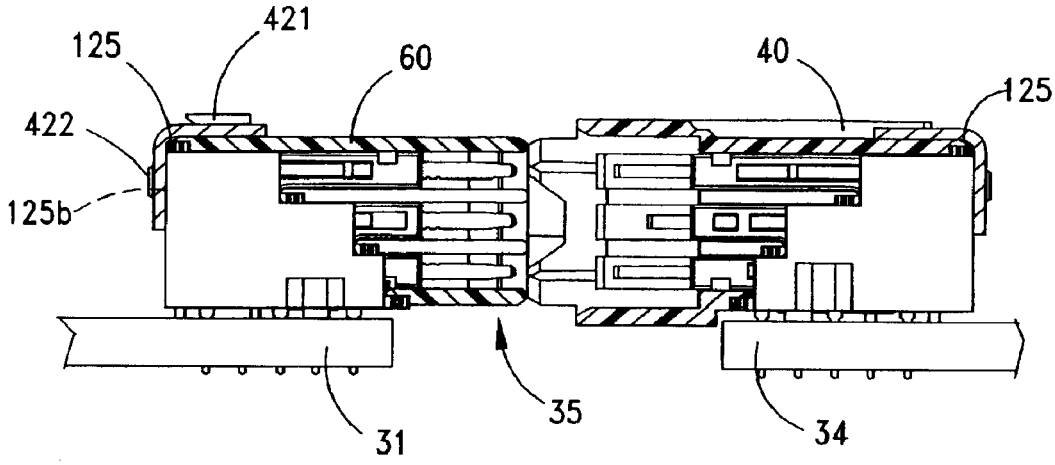
FIG. 25C is a cross-sectional side elevational view illustrating the two connector components in line together immediately prior to their mating together.

FIGS. 25A–C illustrate a pair of circuit boards 30, 31 to which are mounted a pair of connectors 40, 60. These two connectors 40, 60 are interengageable with each other so as to connect the circuits on the two circuit boards together. Of these two connectors 40 and 60, one is considered a receptacle 40 in that it is a female portion that receives a complementary and mating male plug portion 60. These two connectors 40, 60 are interengageable with each other so as to connect the circuits on the two circuit boards together. As is well-known, the two circuit boards can each carry electrical components, examples of which include but are not limited to microprocessors, memory devices but also including analog circuitry as well. Electrical components on the circuit boards are electrically coupled to conductors in the connector portions 40 and 60.

Both connectors extend partially past the edges 32, 33 so that they may be used to provide a connector that enables the "docking" of one circuit board to, or with, another circuit board, or of two electronic components together. The two connectors 40, 60 may be considered as making up a single connector assembly 35 in one embodiment of the invention. When the two connector portions 40 and 60 are coupled together such that the conductors in each portion 40 and 60 engage, the electrical components on circuit boards to which the portions 40 and 60 are attached can be themselves electrically coupled together through the connector portions 40 and 60.

In FIGS. 25B & 25C, a plug connector 60 is shown mounted to one of two circuit boards 30. In instances where the connector is mounted to a circuit board and the circuit board 30 lies beneath the connector component, such a mounting is considered to be a "standard" mounting. FIG. 25C illustrates the two connectors arranged to mate with each other in such a standard mounting arrangement. In such a standard mounting, the two circuit boards to which the connector components are mounted will generally lie in the same plane as shown along the bottom of FIG. 25C. In another instance, the connector component may be mounted in an "inverted" fashion where one circuit board 30 is raised above the other and lies generally in a second, but parallel plane. This is shown in FIGS. 25A–25B. FIG. 25C further illustrates the two connectors arranged to mate with each other in such a standard mounting arrangement. The connectors of the invention are useful in both such mounting applications and are further useful in the transmission of high speed electrical signals between circuits on the two circuit boards.

FIGS. 1–4 illustrate one of the connectors 40 of the assembly 35 and the one that is considered as a receptacle connector. The connector 40 has a front, or mating face, 41 that engages with an opposing connector 60, at a top face 42, two side faces 43, a rear face 44 and a bottom face 45. The connector 40 itself includes a two-part assembly that preferably includes upper and lower housing components, respectively numbered 47 and 48.

Figure 1:
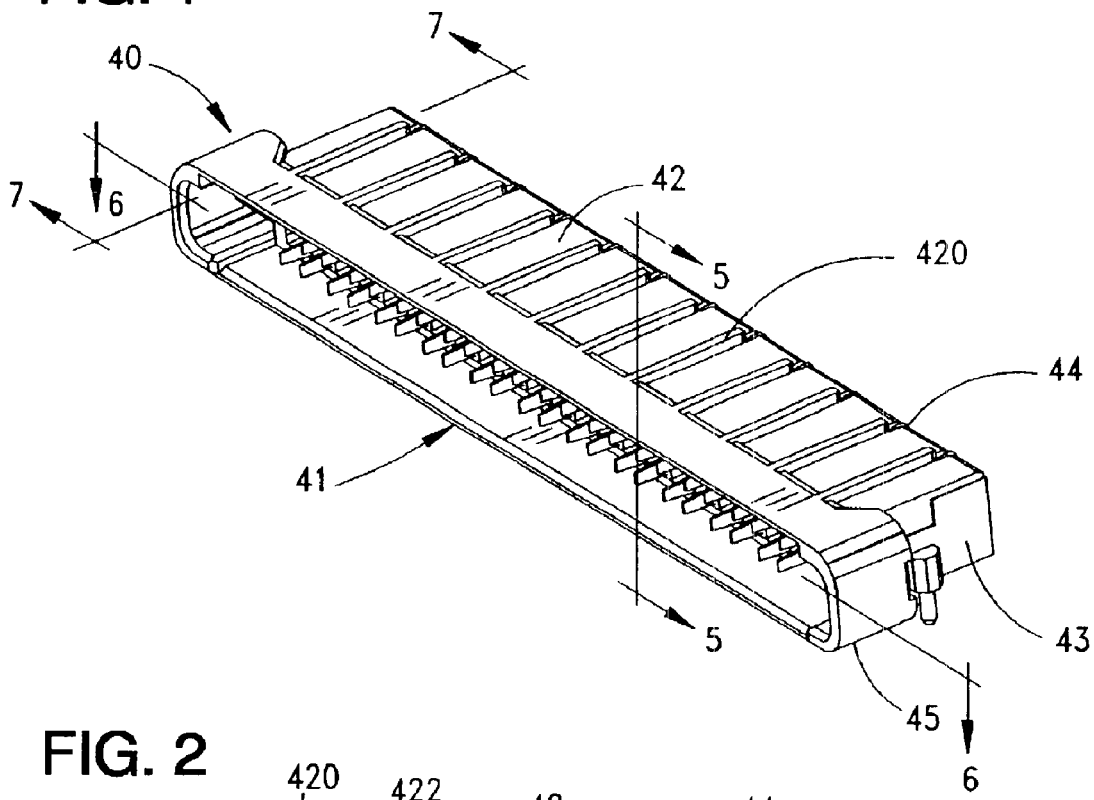
FIG. 1 is a perspective view of a receptacle connector housing used in connector assemblies constructed in accordance with the principles of the present invention.
Figure 2:
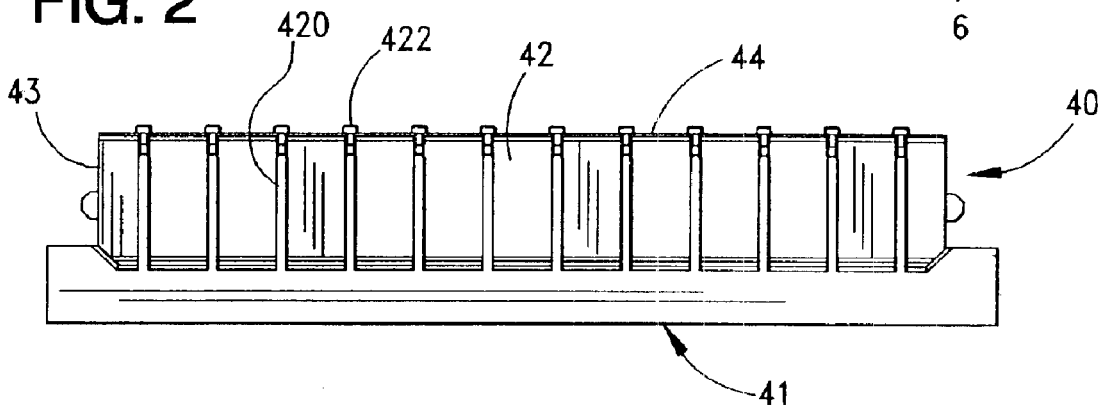
FIG. 2 is a top plan view of the receptacle connector housing of FIG. 1.
Figure 3:
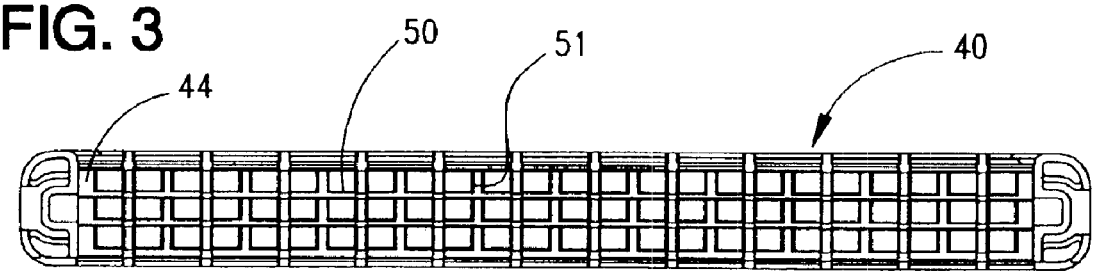
FIG. 3 is a rear elevational view of the receptacle connector housing of FIG. 1.
Figure 4:
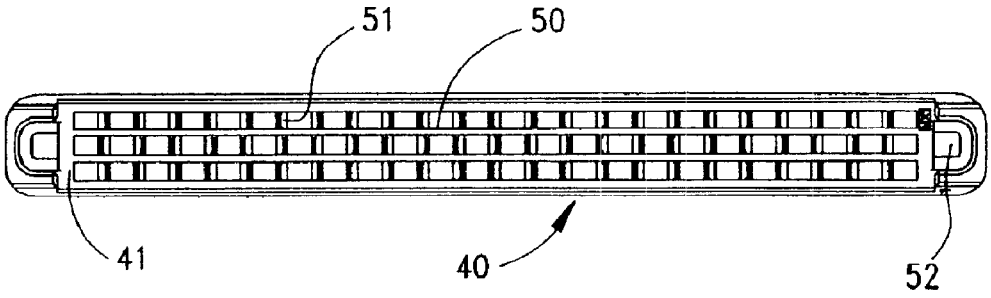
FIG. 4 is a front elevational view of the receptacle connector housing of FIG. 1.
Figure 5:
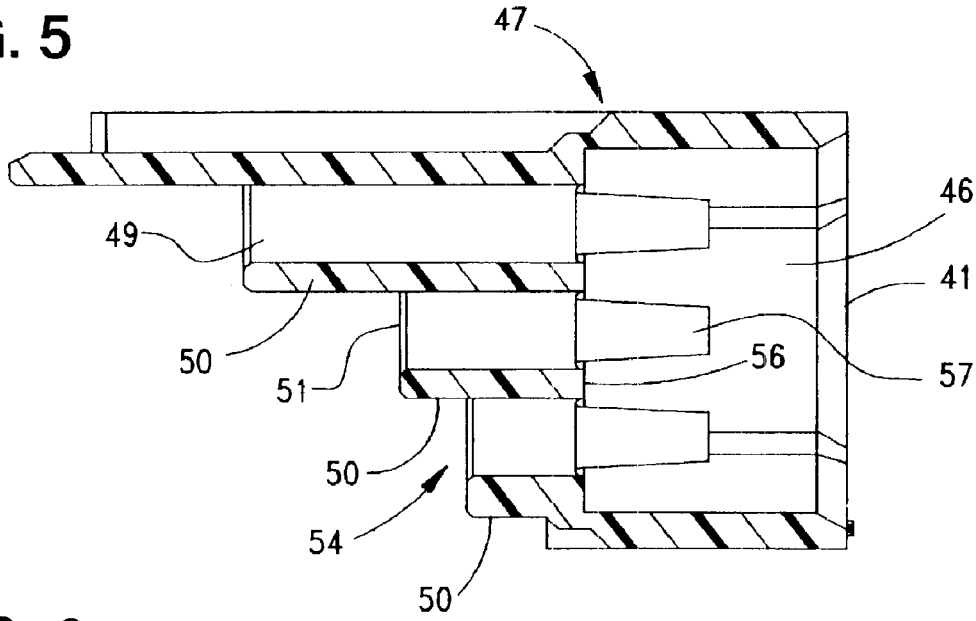
FIG. 5 is a vertical cross-sectional view of the top connector component of the connector housing of FIG. 1, taken along lines 5—5 thereof.
Figure 6:
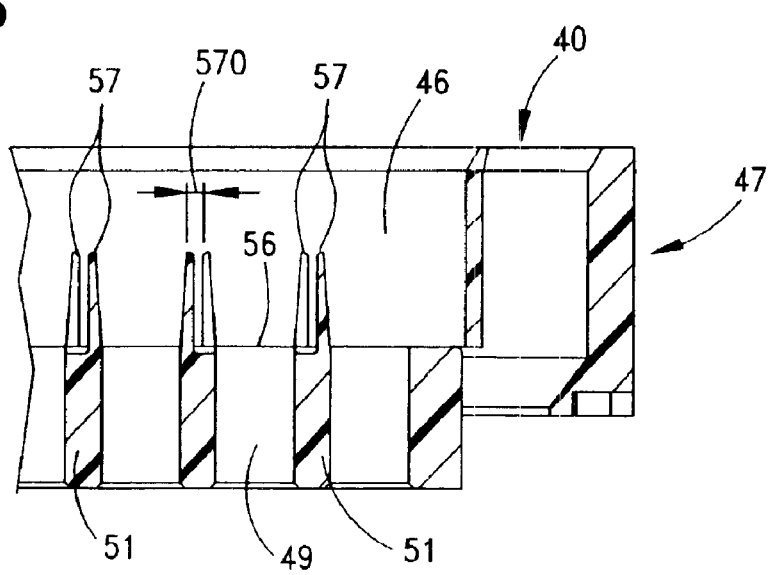
FIG. 6 is a horizontal partial cross-sectional view of the top connector component of the receptacle connector housing of FIG. 1 taken along lines 6—6 thereof.
Figure 7:
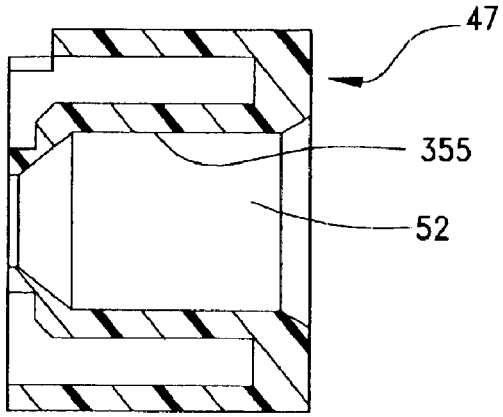
FIG. 7 is a vertical cross-sectional view of the engagement area of the receptacle connector housing of FIG. 1 taken along lines 7—7 thereof.

FIGS. 5–7 illustrate the upper housing 47 in cross-section. As illustrated, the upper housing 47 has a plurality of horizontal passages, or cavities 49, that extend through the depth (or length) of the upper housing 47 to the mating face 41, and from the rear of the upper housing 47 to the front hollow receptacle portion 46. The cavities 49 of the upper housing 47 are defined by internal walls 50, 51 that are preferably formed integrally with the housing, such as during the molding of the housing and which extend crosswise to each other, preferably in the horizontal (50) and vertical (51) directions. These internal walls 50, 51 intersect with each other at a series of nodes that cooperatively define the cavities 49. The purpose of these cavities 49 will be explained in detail below. On the outer sides of the receptacle 46, two other receptacles 52 (FIG. 4) are formed which receive projecting plug portions of an opposing connector as described below.

The vertical walls 51 may be formed, at their leading edges 56, with ground contact blade portions 57 that extend forwardly into the receptacle area 46. These will engage opposing parts of the opposing connector.

Figure 8:
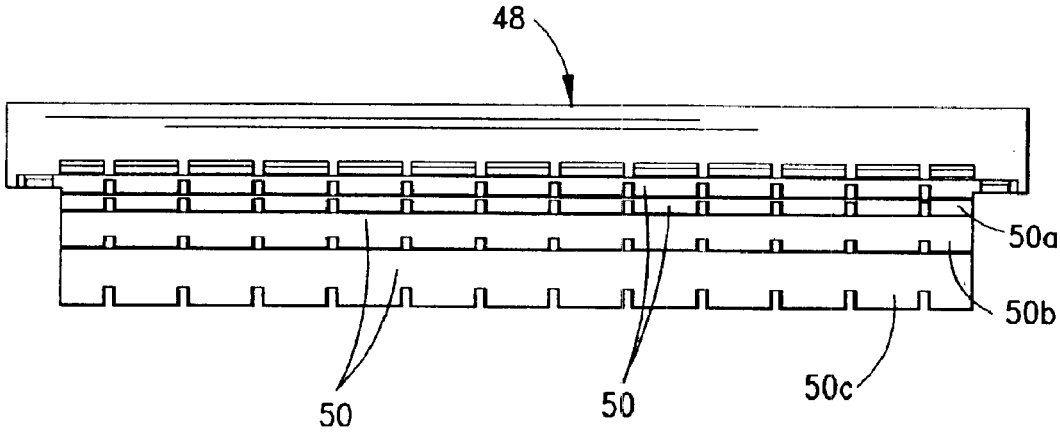
FIG. 8 is a bottom plan view of the receptacle connector housing of FIG. 1.
Figure 9:
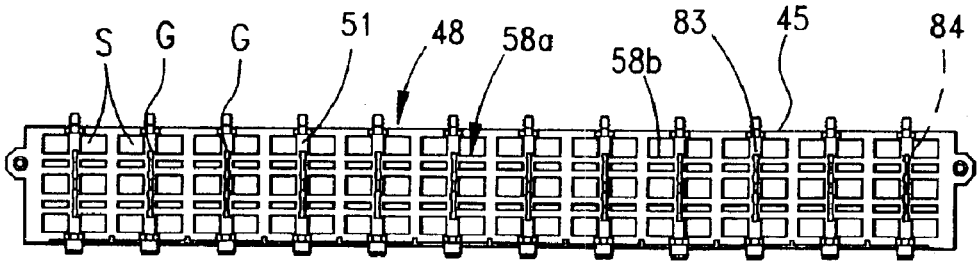
FIG. 9 is a bottom plan view of a connector lower housing capable of use with both the plug and receptacle connector housings of the present invention.
Figure 10:
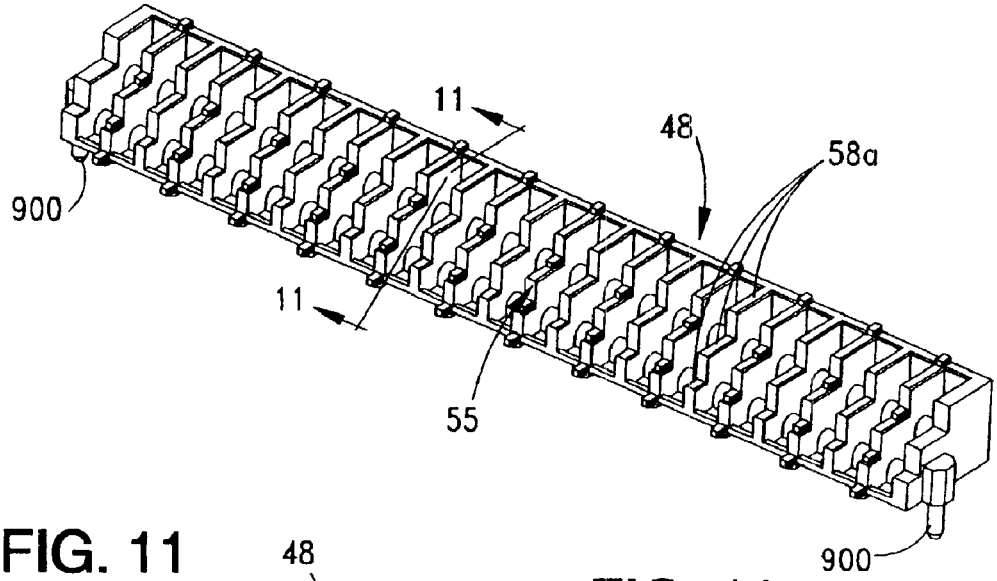
FIG. 10 is a perspective view of the lower housing of FIG. 9.
Figure 11:
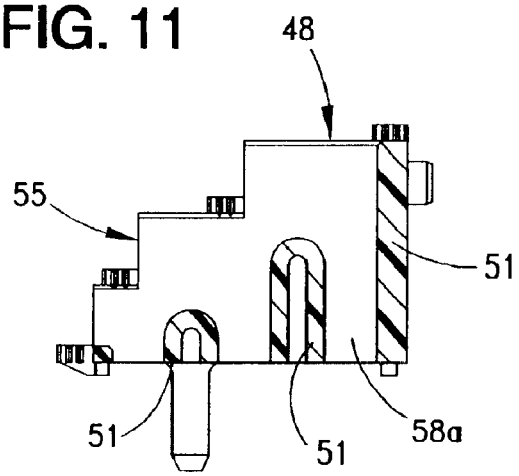
FIG. 11 is a vertical sectional view of the lower housing of FIG. 10, taken along lines 11—11 thereof.

The upper and lower housings 47, 48 are formed with a stepwise profile along their mating interfaces 54, 55. In this manner, the lower housings 48 are given a hermaphroditic nature, meaning they may be used with the upper housings of both the plug and receptacle connectors 60, 40, respectively. The lower housing 48 is illustrated in FIGS. 8–10. In FIG. 10, it can be seen that the lower housing 48, with its vertical walls 51, has a series of vertical cavities 58*a* formed therein. These vertical cavities 58*a* mate with the horizontal cavities 49 of the upper housing 47 and when mated together, a series of L-shaped cavities, or passages, are formed within, or internally of, the combined housings.

Figure 13:
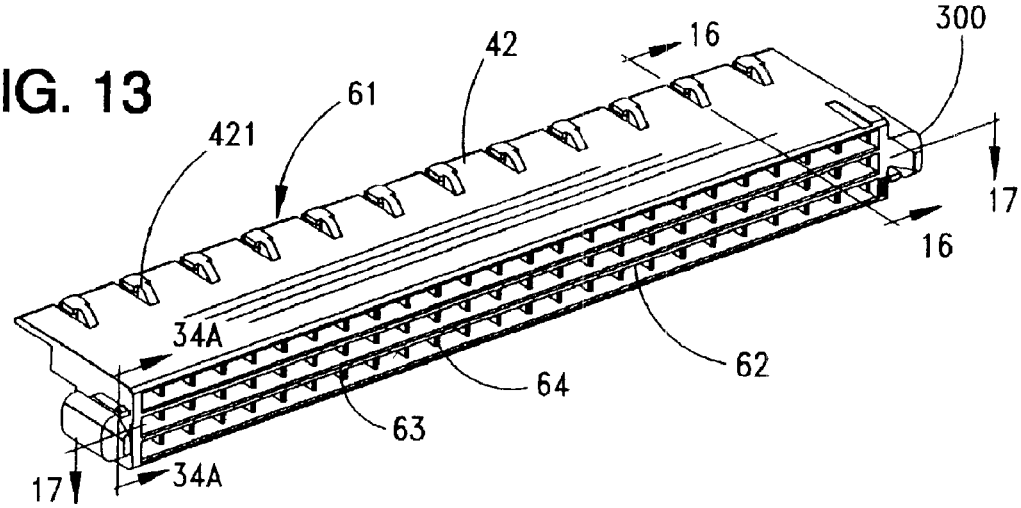
FIG. 13 is a perspective view of a plug connector housing constructed in accordance with the principles of the present invention.
Figure 16:
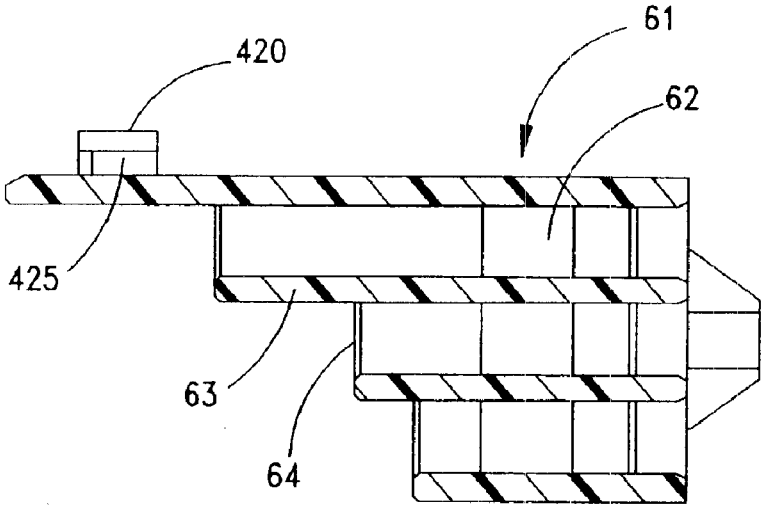
FIG. 16 is a vertical sectional view of the plug connector of FIG. 13, taken along lines 16—16 thereof.
Figure 17:
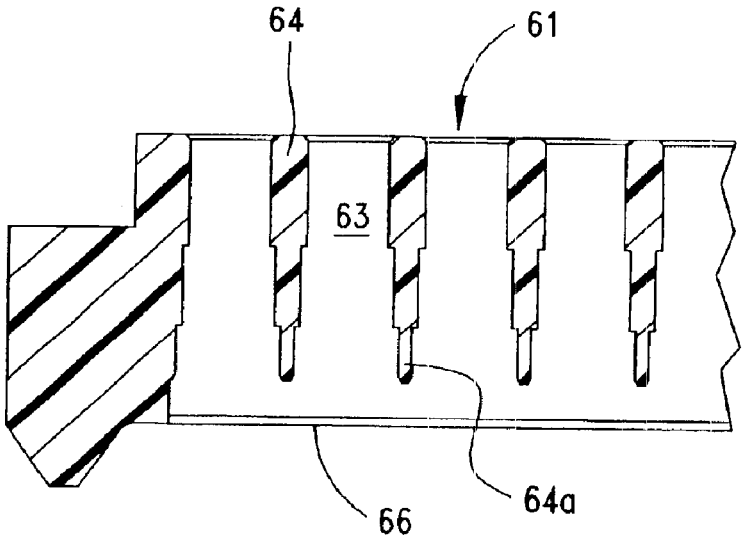
FIG. 17 is a partial horizontal sectional view of the plug connector of FIG. 13 taken along lines 17—17 thereof.

As seen in FIGS. 5 and 8, the upper receptacle housing 47 has a series of horizontal walls 50 that have different lengths, which will accommodate insertion of the terminal assemblies therein. As seen in FIG. 9, the bottom face 45 of the lower housing 48 has openings 58*b* that communicate with its cavities 58*a*. FIG. 13 illustrates the upper housing 61 of the plug connector component 60 of the connector assembly 35. As seen in FIGS. 13–16 the upper housing 61 has a plurality of internal cavities 62 that are arranged in rows and columns, preferably in the same spacing as the rows and columns of internal cavities 62 of the receptacle connector upper housing. As shown in FIG. 16, the upper housing 61 has a plurality of horizontal sidewalls 63 and vertical walls 64 (FIG. 15) which intersect together to define the individual cavities 62. The vertical walls 64 of the plug connector upper housing 61 are tapered as shown in FIG. 17 and their leading edges project forwardly to a location near the front face 66 of the upper housing 61. The contact blade portions 56 of the receptacle connector upper housing 40 will mate with and engage the leading edges of the vertical walls of the plug connector upper housing, and because of the conductive plating on these surfaces, will provide a reliable electrical connection between the two connector components 40, 60 when mated together.

Interstitial Ground at Circuit Board Interface

Figure 12:
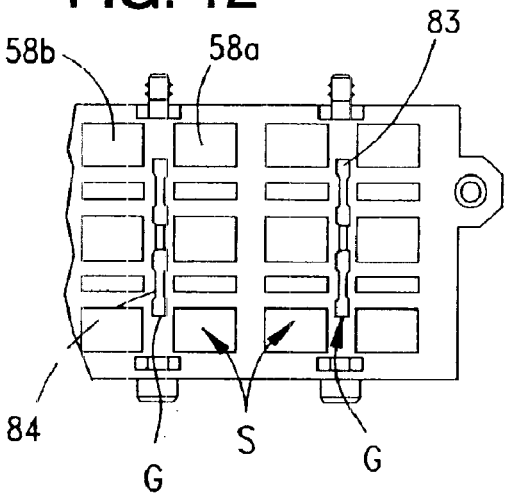
FIG. 12 is a partial enlarged bottom plan view of the lower housing of FIG. 11.
Figure 12A:
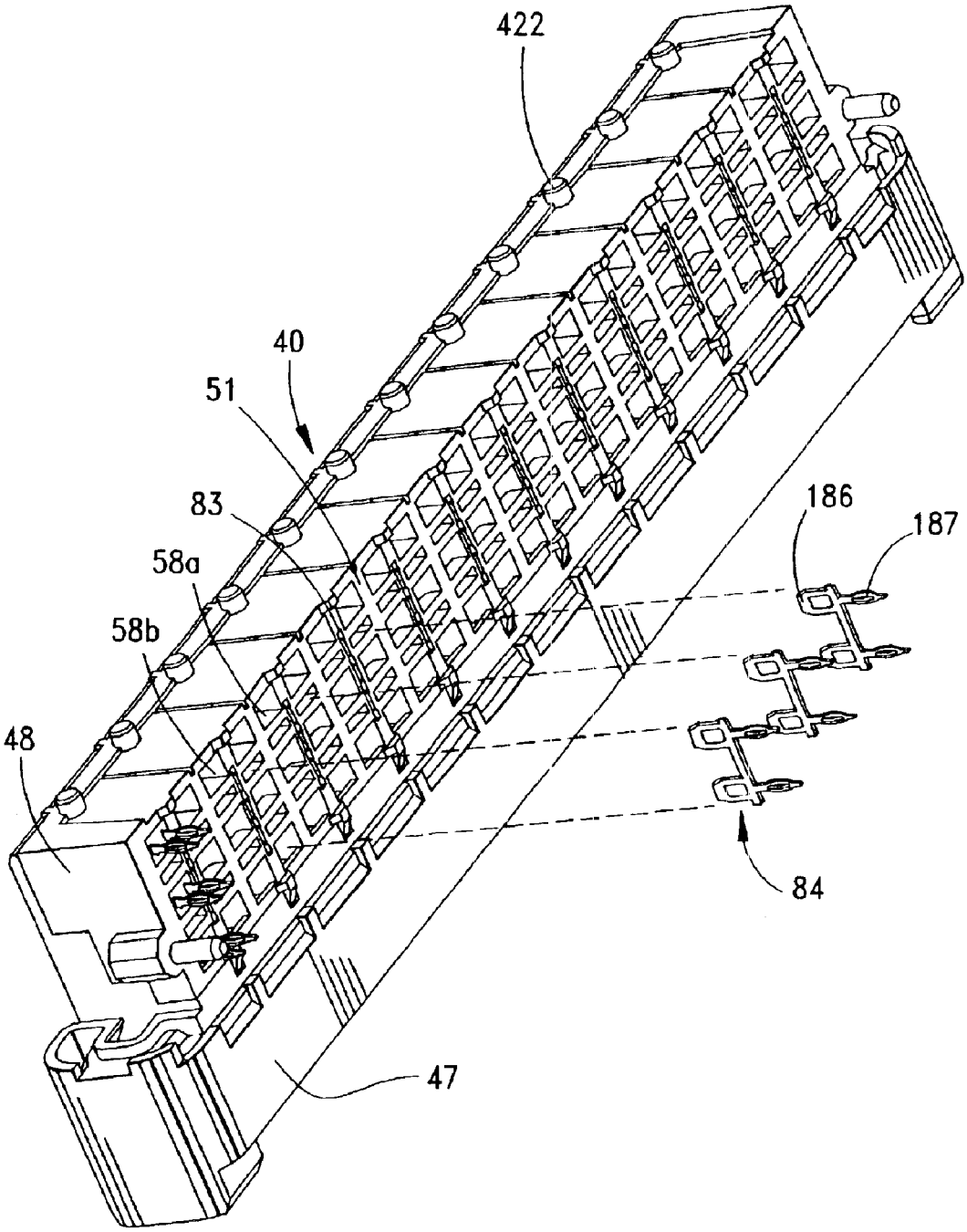
FIG. 12A is a perspective view, taken from the bottom, of an assembled receptacle connector with one terminal assembly in place therein and with three of the housing ground terminal sets illustrated as exploded from the connector.
Figure 27:
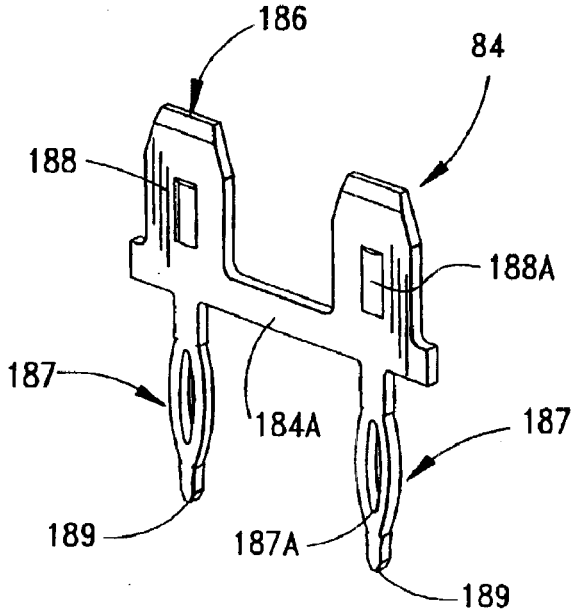
FIG. 27 is a perspective view of a ground terminal that is insertable into the lower connector housings for providing a connection between the lower connector housings of circuit boards.
Figure 28:
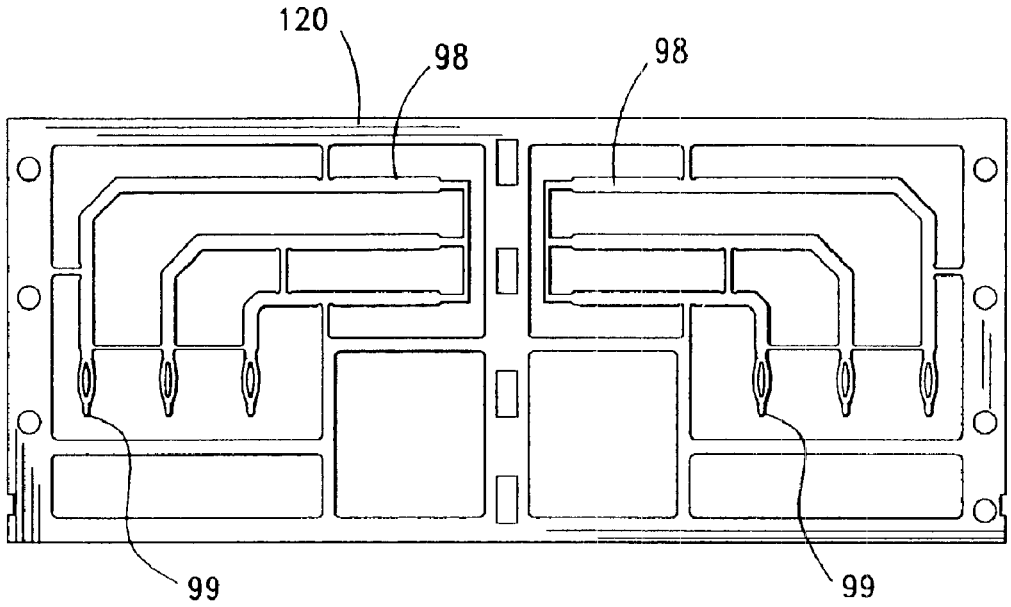
FIG. 28 is a plan view of a set of six terminals stamped in place within a carrier strip for use in a terminal assembly.

In accordance with one primary aspect of the present invention, an interstitial ground arrangement is provided on the face of connector 40 or 60 that interfaces with circuit boards 30 or 31. Such interstitial ground arrangements for the connector of the docking type is best seen in FIGS. 12A and 31B. A plurality of transversely extending walls 51 subdivide the lower housing 48 into a plurality of channels, such as channels 58*a*, 58*b* (FIG. 12) into which differential signal pairs 99 are inserted, as seen in FIG. 31B. As seen in FIGS. 12 & 12A, a slot 83 may be provided in every other transverse wall 51 for receiving a ground terminal assembly 84 therein. These conductive ground terminals 84 are shown in greater detail in FIG. 27. The ground terminals 84 serve to connect the entire extent of the lower housing 48 to ground circuits of the circuit boards 30, 31. The structure of these ground terminals 184 is shown in FIG. 27, and each terminal 184 includes a housing retention portion 186 and a terminating portion 187. The housing retention portion 186 of each such terminal preferably includes a pair of planar heads 188, which are indented, or dimpled, to form a projecting part 188A on one side of the head 188 which provides an interference fit with the ground terminal-receiving slot 83. The terminating portion 187 includes one or more tails 189, shown as compliant pins of the "eye of needle" variety, which includes a center opening 187A surrounded by deformable sidewalls of the tail, as is known in the art.

When ground terminals 84 are inserted into slots 83 of transverse walls 51, as shown in the examples of FIGS. 12A and 31B, each ground terminal assembly 84 will be adjacently disposed to differential signal pairs 99 located in channels 58, including channels 58*a*, 58*b*. Preferably, the ground terminals 187 are not necessarily aligned with the rows and columns defined by the differential signal terminals 99, but are instead disposed at an intermediate or diagonal position between the differential signal terminals 99. Thus, in the examples of FIGS. 12A and 31B, each ground terminal 187 on the ground terminal assembly 84 will be located approximately equidistant from four differential signal terminal pairs. The ground terminal assemblies 84 will also subdivide the differential signal terminal pairs into blocks of six. Of course, as shown in FIG. 31B, additional slots 83*a* could be provided in every transverse wall 51, such that the terminal assemblies would subdivide the differential signal terminal pairs into rows of three (or even a single differential signal terminal pair), if so desired.

The terminal tails 189 of the ground terminal assemblies 84 will connect to ground circuits or planes in circuit boards 30, 31, and the ground terminals will thereby provide an affinity for differential signals in adjacent differential signal pairs 99 through the interface between the lower connector assembly 48 and the associated circuit board. This will serve to provide a lower impedance across the connector to circuit board interface for the differential signals, and will also avoid discontinuities in impedance thereacross. The use of these ground terminals between distinct sets of differential signal terminal pair tails serves to significantly reduce the ground path from any one pair or signal terminal to ground in comparison to an ordinary connector housing equipped only with a pair of ground lugs 900 (FIG. 10) that are typically disposed at the opposite ends of the housing along the mounting face thereof.

Of course, the ground terminal assemblies 84 could alternatively be arranged along the longitudinal walls of the lower housing 48, instead of on the transverse walls 51 as shown in FIGS. 12A and 31B. As with the illustrated embodiment, it would be preferable to have the ground terminal assemblies disposed adjacently to sets or groups of differential signal pairs 99. In yet another possible variation of the disclosed embodiment, the ground terminal assemblies 84 could be disposed on both the transverse and longitudinal walls of the lower housing 48 adjacently to sets or groups of differential signal pairs 99.

Integral Ground Structure of Connector Housing

Preferably, the surfaces of both the upper and lower housings 47, 48 are coated with a conductive material such as a thin layer of metal. This is suitably accomplished by way of plating the plastic or insulative material from which the housings are formed with a metal coating on substantially all of their exterior surfaces. This technique is known in the art as "plated plastic". This conductive plating serves at least two purposes. One such purpose is that the plating provides a continuous conductive surface that extends along the housing-board interface of the connector housing which commons the plurality of discrete ground terminals 84 together. A second purpose is to provide a proximate and reliable reference ground to the differential signal terminals of each differential signal terminal pairs in their extent through the connector and particularly through the cavities 49 of the connector housing.

Figure 32:
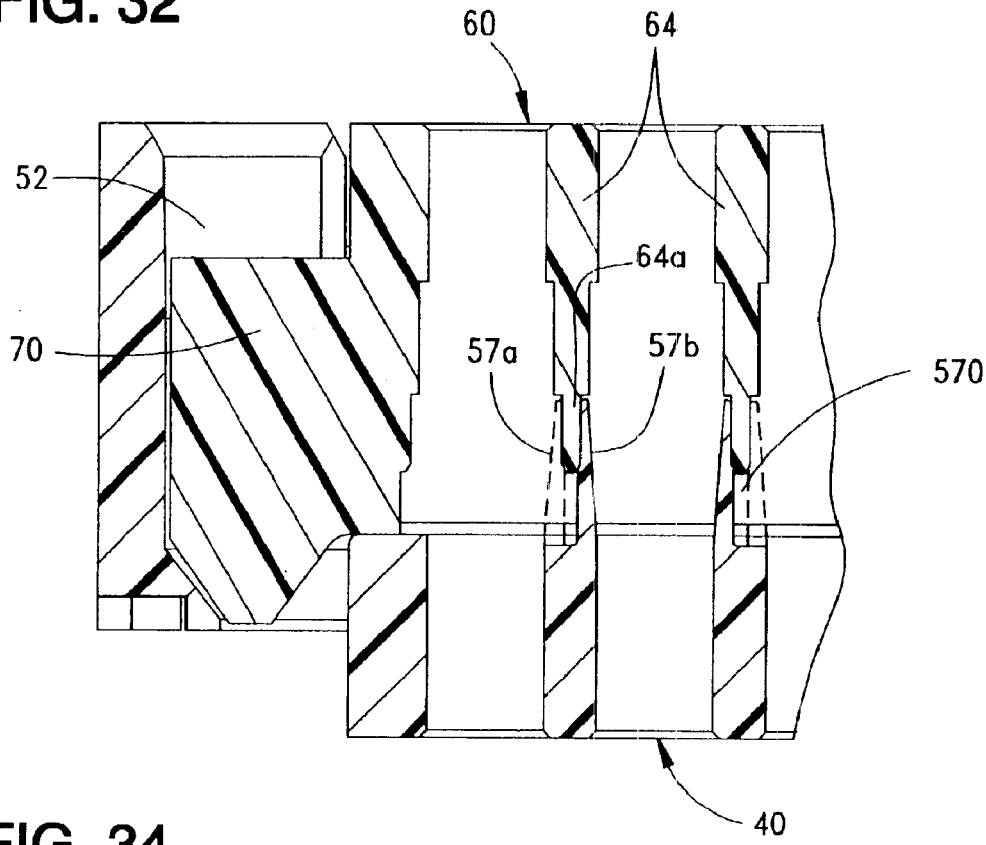
FIG. 32 is a an enlarged sectional, horizontal detail view of the plug and receptacle connector housing top halves mated together, illustrating the end engagement members and the housing central electrostatic discharge mating members in engagement with their corresponding opposing engagement components.
Figure 34:
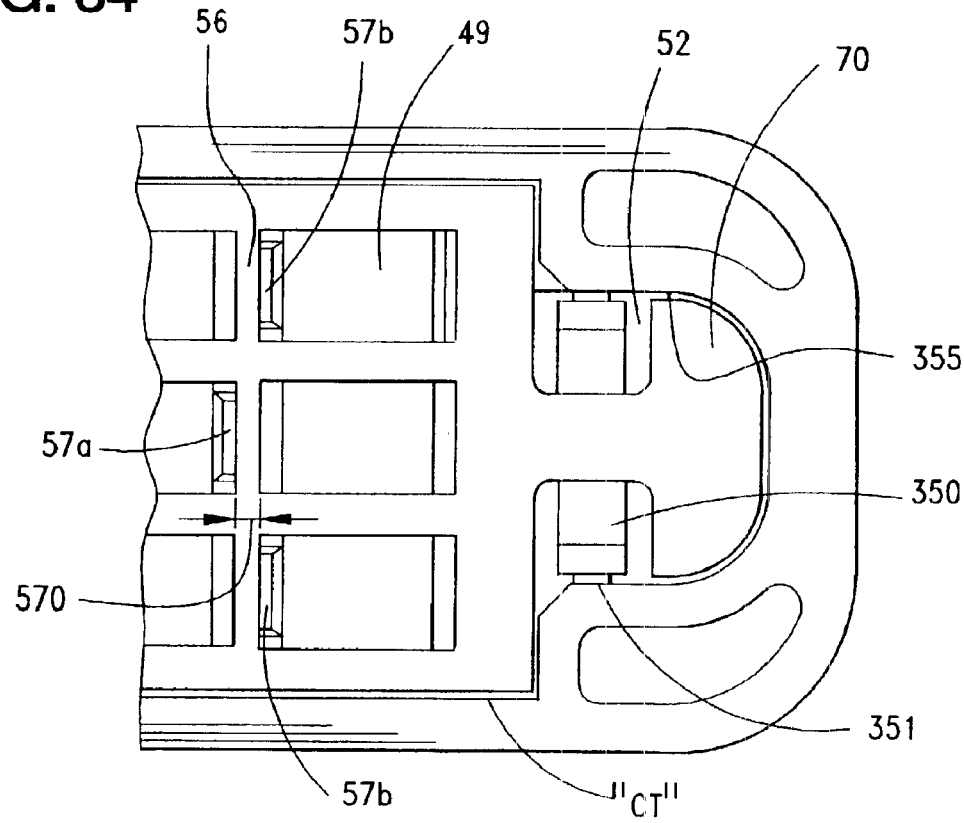
FIG. 34 is an enlarged detail view of the engagement end of the plug and receptacle housings mated together, and taken from the rear thereof in order to illustrate the engagement therebetween.
Figure 33:
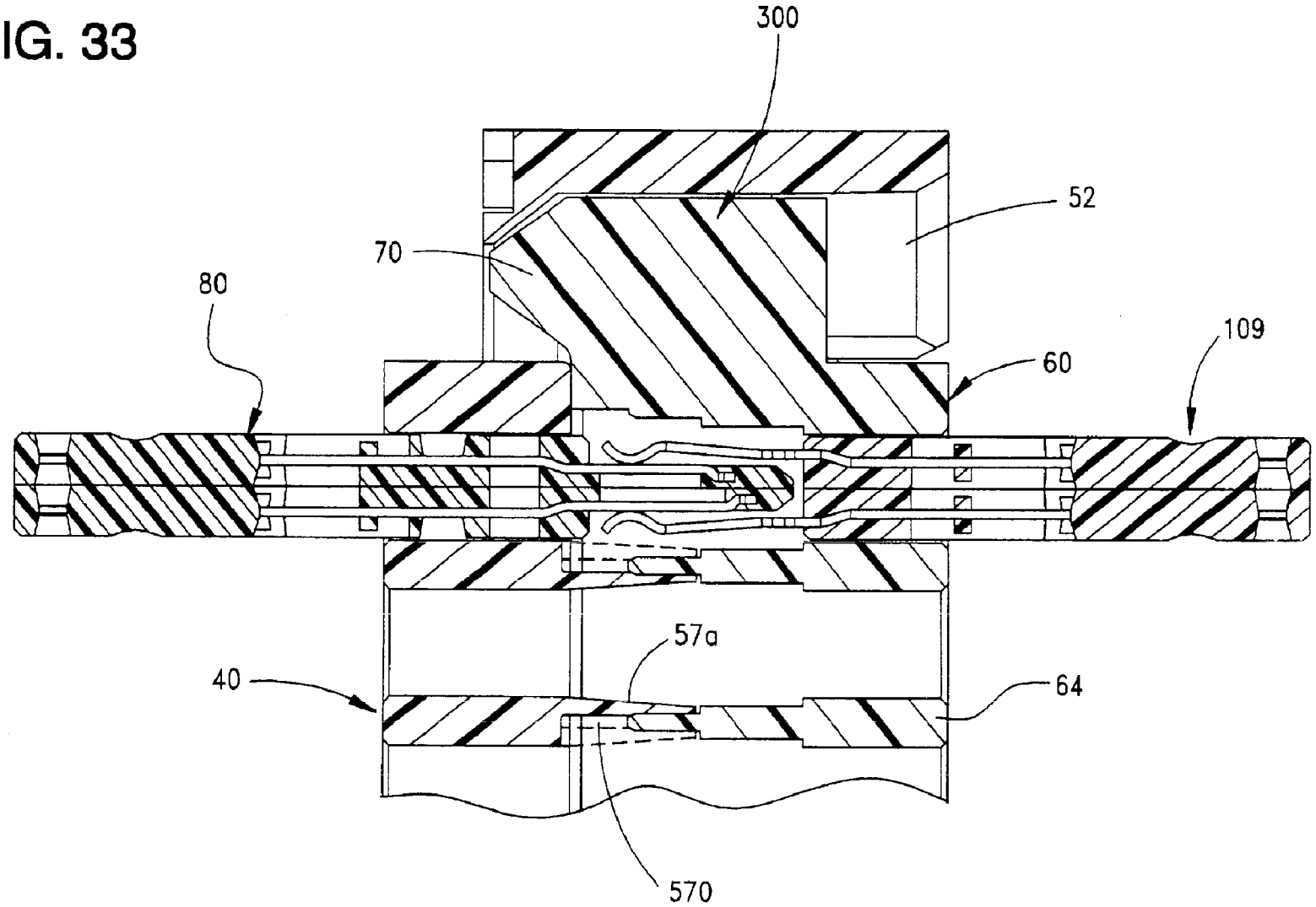
FIG. 33 is the same view as FIG. 32, but with a terminal assembly in place within the plug and receptacle connector housings.

An improved grounding interface is also provided between mating connectors, such as the docking connectors 40, 60 shown in FIG. 25 which provides for a sequential mating sequence between the two connectors. As seen in FIGS. 5 and 6, a plurality of engagement members illustrated as tabs or fingers 57, extend from wall 56 into the hollow receptacle portion 46 of upper housing portion 47. When housing 47 is covered with a conductive surface, fingers 57 are also provided with a conductive surface. As seen in FIG. 34, the fingers 57 may be disposed along opposite sides of wall 56, such as finger 57*a* disposed along the right side of wall 56 and fingers 57*b* disposed along the left side of wall 56, with the fingers 57*a*, 57*b* being considered as forming a "column" of fingers. The fingers 57*a*, 57*b* in each such column are preferably spaced horizontally apart from each other a distance 570, which is shown best in FIG. 6 and which is preferably slightly less than the thickness of the opposing housing vertical wall front parts 64*a*. This relationship provides a reliable interference fit between the connectors as shown in FIG. 32. This mating occurs last and after contact is made between the contact arms 350 (explained below) and the outer walls of the housings, and the terminals. FIG. 33 shows the difference in length between the terminals of the terminal assemblies and the contact fingers 57, with the length of most of the terminals being longer so that they will mate before the housing fingers 57 mate with their opposing walls 64*a*. The interference fit between the fingers 57 and the walls 64*a* also serve to hold and maintain the connectors together in engagement.

As seen in FIGS. 33 and 34, plug connector 60 has a plurality of stepped walls 64 with a narrower stepped end 64*a*. Walls 64 also have an electrically conductive surface. Thus, when connectors 40, 60 are mated, both sides of the stepped ends 64*a* of walls 64 are contacted and gripped between fingers 57*a* and 57*b* to provide a means of making electrical contact between connectors 40, 60. It will also be appreciated that the mated combination of the stepped walls 64 with the fingers 57 provides a relatively continuous conductive passage about the differential signal pairs such that the impedance seen by the differential signal pairs at the interface of connectors 40, 60 is relatively uniform without any significant discontinuities.

Figure 14:
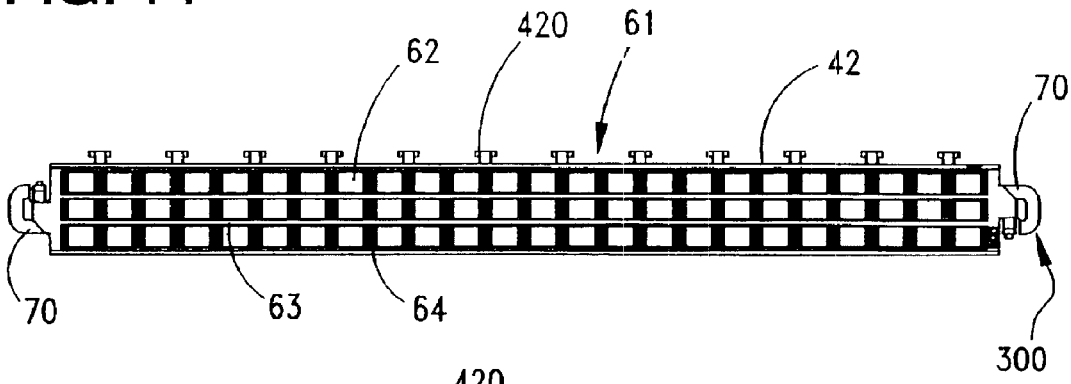
FIG. 14 is a front elevational view of the plug connector of FIG. 13.

As shown in FIG. 14, the plug connector upper housing 61 preferably includes a pair of engagement plugs 70 that are useful in blind-mate applications and which extend longitudinally of the upper housing 61 and which are received within the channels, or receptacles 72, that are formed on the outer sides of the receptacle connector upper housing 40, as shown in FIGS. 6 and 7. Although these plugs 70 are used to locate the two connectors together in mating alignment (and as such, may be made different or larger to provide a means for polarizing the engagement of the two connectors), the plugs 70 do not immediately make contact with the opposing connector due to tolerances. Rather, that is accomplished by way of contact members that are formed as part of the engagement plugs 70. The contact members (arms 350) make contact through respective contact with the inner surfaces 355 of their respective engagement holes 52 formed in the receptacle connector as shown in FIGS. 7, 34 & 34A.

Figure 15:
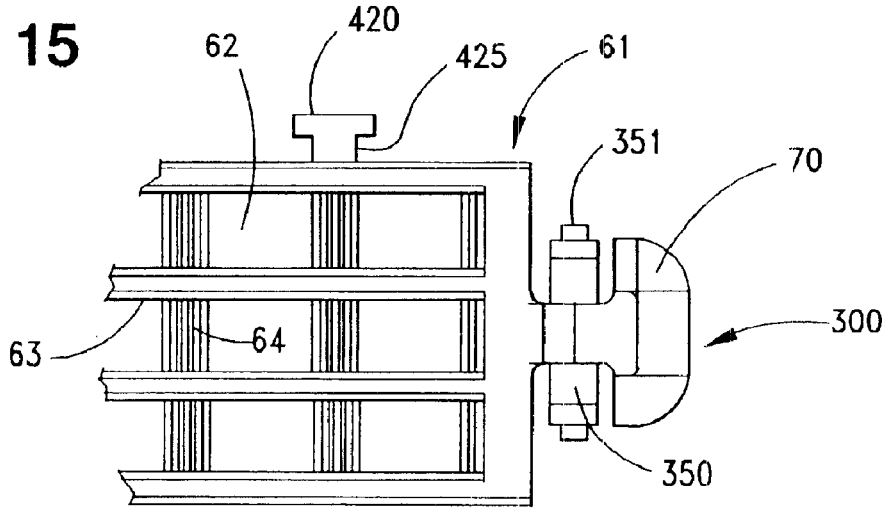
FIG. 15 is an enlarged detail view of the right end of FIG. 14.
Figure 15A:
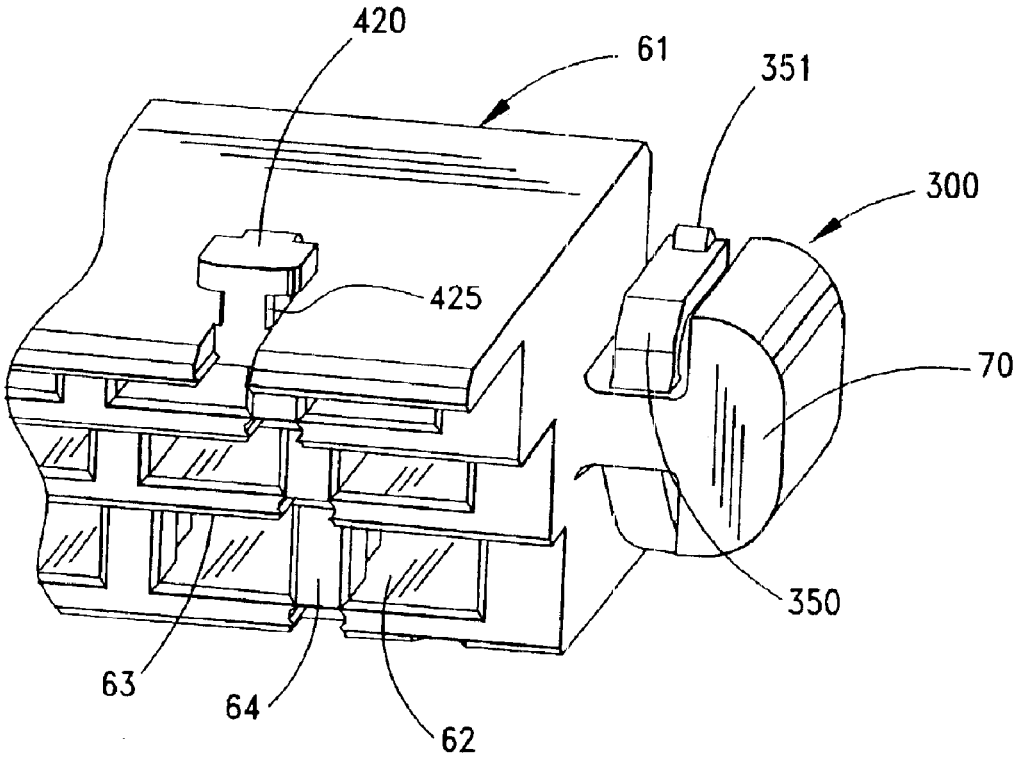
FIG. 15A is an enlarged detail view of one end of the plug connector of FIG. 15, taken from the rear thereof.
Figure 34A:
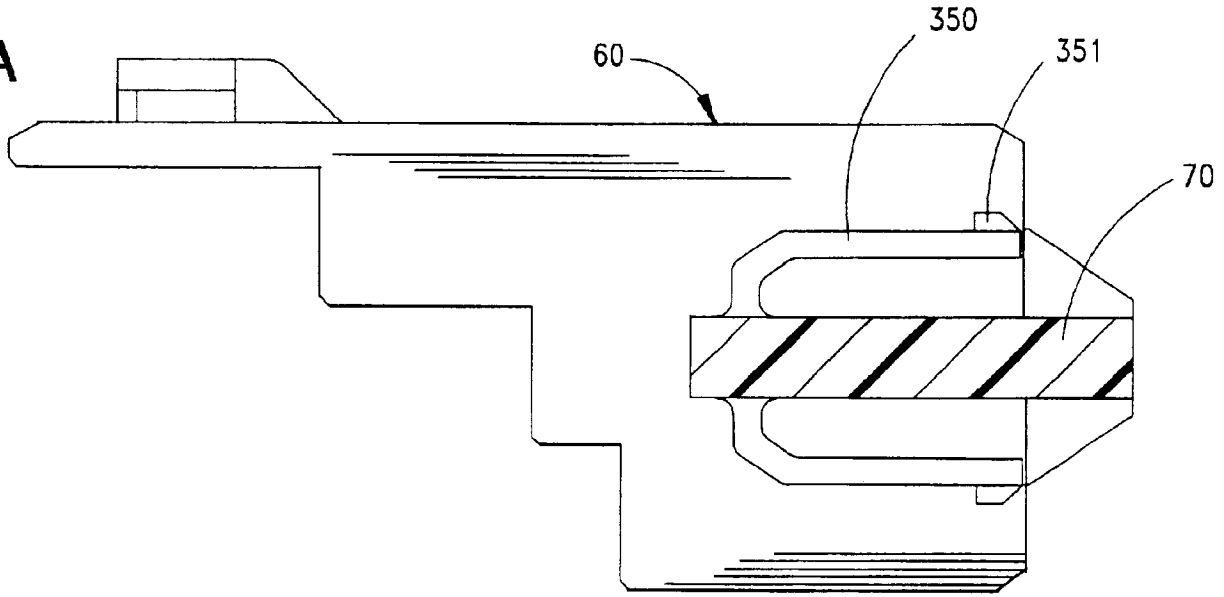
FIG. 34A is a side elevational view of the plug connector housing of FIG. 13, taken along lines 34A—34A.

These members are shown as contact arms 350 that are cantilevered out from the base of the engagement plug 70 and this structure is shown best in FIGS. 15, 15A & 34A, and they terminate in flexible contact points 351. This cantilevered structure permits them to be spaced from the plug 70 a distance that is slightly greater than the distance to the inner surface 355 of the opposing holes 52 and they will deflect upon contact with the holes so that the contact points make the first contact when the connectors are mated together and are the last to break contact when the connectors are pulled apart from each other.

Figure 31A:
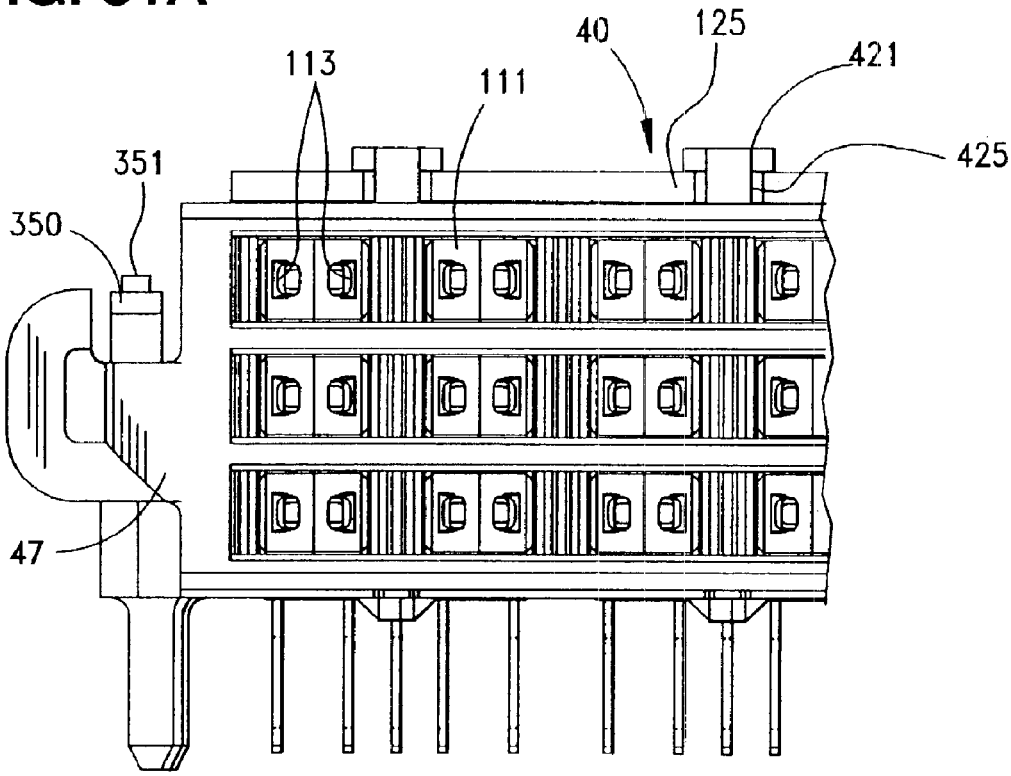
FIGS. 31A and 31B are schematic views illustrating the isolation of differential signal terminals at both the mating interface and at the circuit board interface of the connectors of the invention, respectively.
Figure 31B:
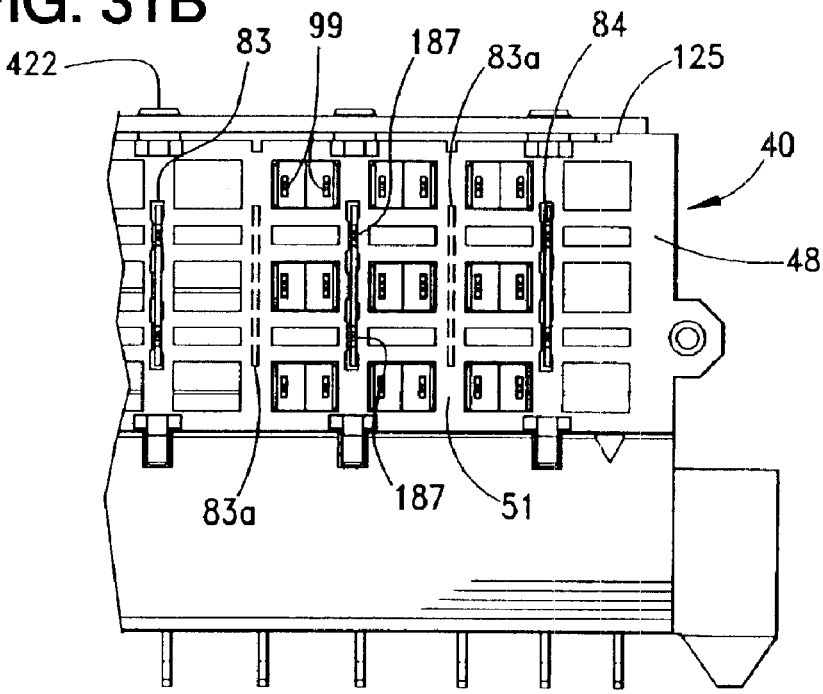

FIGS. 31A and 31B illustrate the overall isolation of the differential signal pairs obtained by the present invention. In the mating interface, each differential signal pair is held within an enclosure of at least four walls of each of the two connector components. Because the walls are plated with a conductive material, they will serve to define a ground that encompasses each differential signal pair. This ground serves to isolate each such pair at the mating interface. The ground isolation continues through the connector component through the lower housing portion thereof, where the vertical legs of the terminal assemblies are encompassed on four sides by plated portions of the connector component lower housing, thus obtain a similar, if not identical isolation as obtained in the mating interface. A ground potential for signals on the terminal assembly is provided by the conductive surface on the interior walls of the volumes 59. Because the differential signal pairs are substantially surrounded by a conductive surface embodied as the connector halves and thereby electrically shielded from electrostatic discharge (ESD) the signal-to-noise ration is improved over the prior art. Moreover, by adjusting the spacing and geometry of the connector halves, impedance can be adjusted as well. That there are three, sequentially-made ground connections established before the differential signals are made further insures suppression of ESD pickup.

Terminal Assembly

Figure 18:
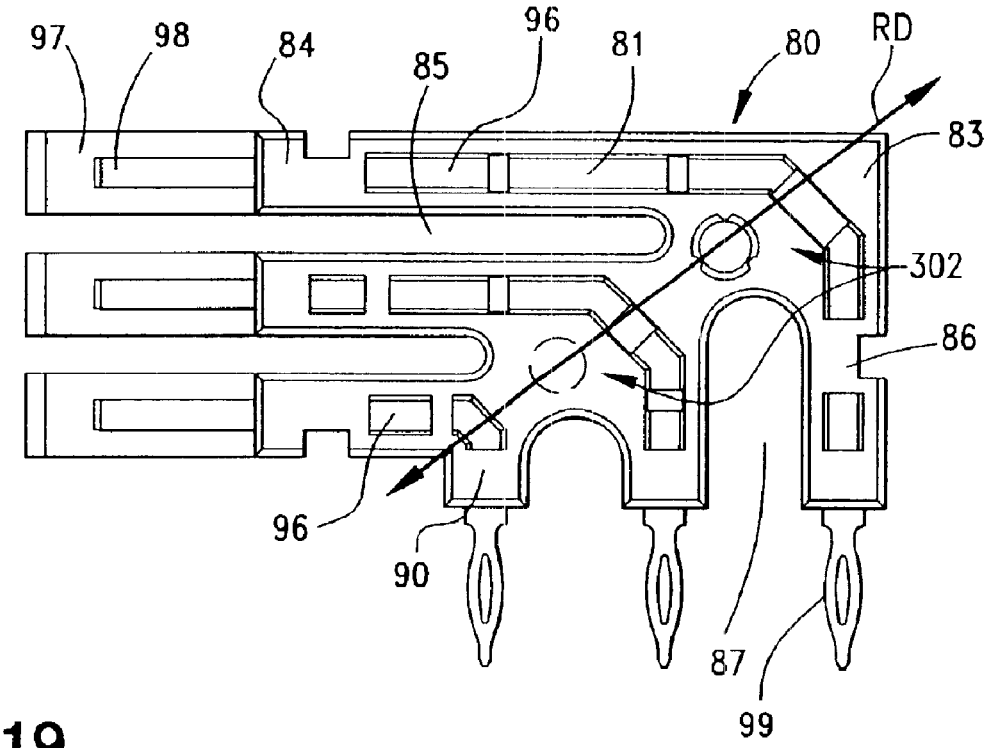
FIG. 18 is an elevational view of a signal terminal assembly constructed in accordance with the principles of the present invention and used in the receptacle connector housing of FIG. 1.
Figure 19:
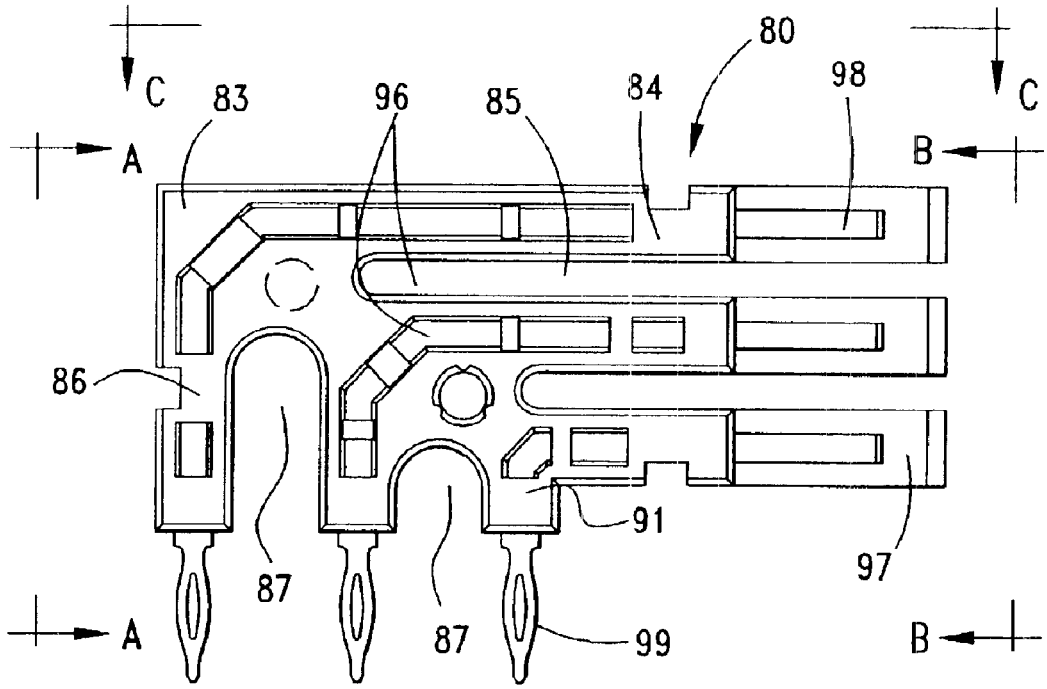
FIG. 19 is an elevational view of the opposite side of the signal terminal assembly of FIG. 18.
Figure 20A:
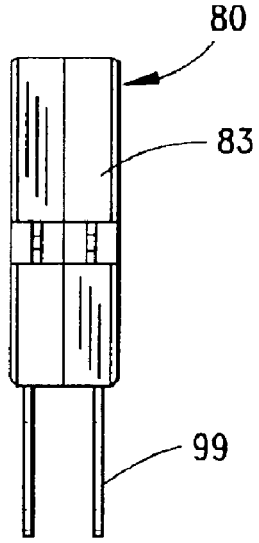
FIG. 20A is a rear elevational view of the signal terminal assembly of FIG. 19, taken along lines A—A thereof.
Figure 20B:
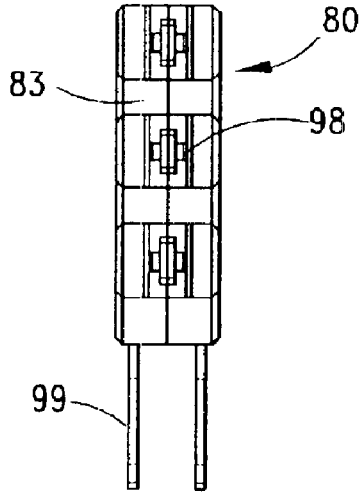
FIG. 20B is a front elevational view of the signal terminal assembly of FIG. 19, taken along lines B—B thereof.
Figure 29:
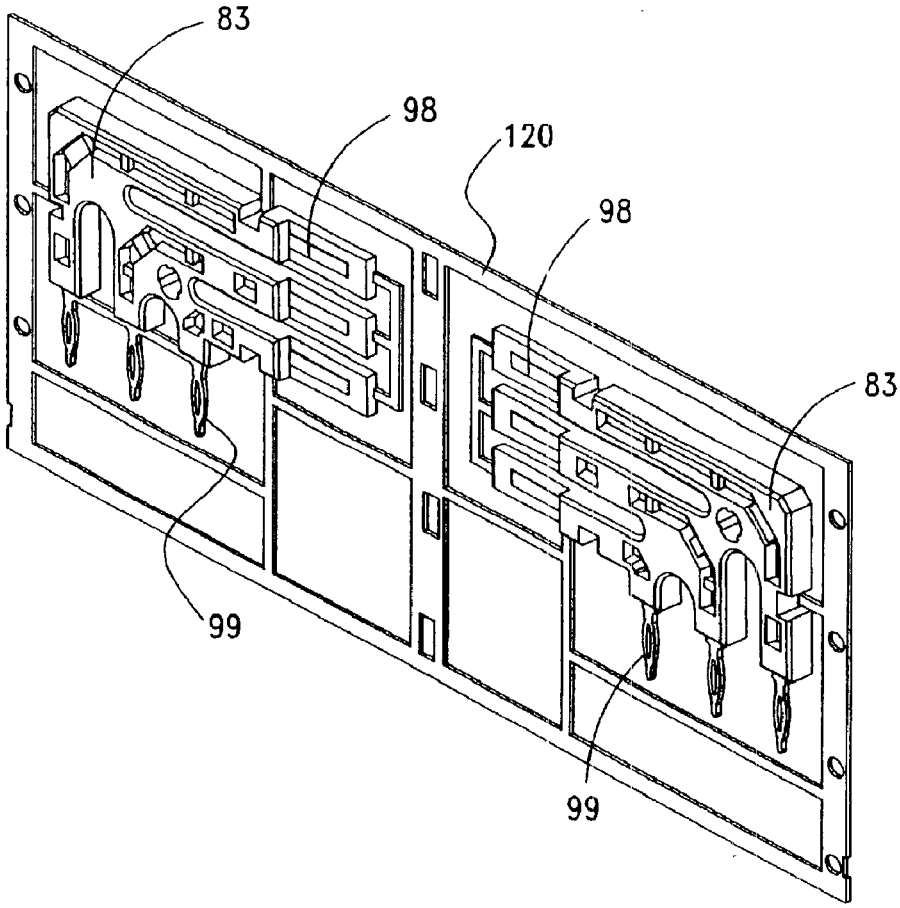
FIG. 29 is a perspective view of the carrier strip of FIG. 28 with insulative housings, or body portions molded thereto.

FIG. 18 illustrates a terminal assembly 80 that houses a plurality of conductive terminals 81 within an insulative body or support frame portion 83. The terminal assembly 80, by way of its body portion 83, may be considered as having horizontal legs 84 that are separated by intervening slots 85 that receive horizontal walls 50, 60 of the upper housing 40, 61 and also vertical legs 86 that are separated by intervening slots 87 that receive vertical walls 51 of the lower housing 48. The slots 85 and 87 are separated by intervening web portions 302 which extend along an axis "RD" shown in FIG. 18. The insulative body portion 83 is preferably formed on them after the stamping as illustrated in FIG. 29, and preferably by insert molding. FIG. 18 illustrates one side 90 of the terminal assembly 80, while FIG. 19 illustrates the other side 91 of the terminal assembly 80. The two halves, or pieces, are mirror images of each other and each includes, on opposing sides thereof, raised engagement bosses 94 or engagement recesses 95. The two halves are assembled together along a central dividing line, as illustrated best in FIGS. 20A-20C, and the insulative body portions may include a plurality of slots, or openings formed therein 96 which overlie portions of the terminal interconnecting portions. These openings, as shown in the drawings follow the path P of the terminals through the terminal assembly.

Figure 20C:
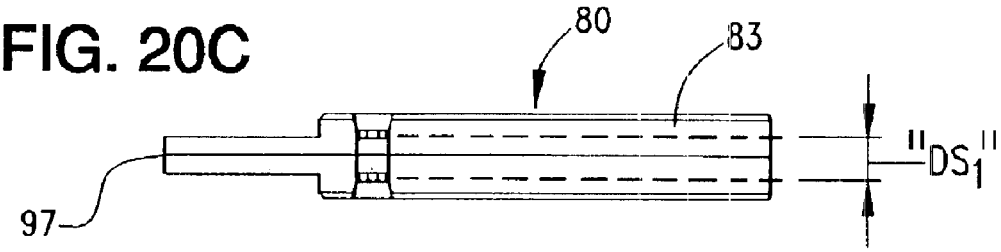
FIG. 20C is a top plan view of the signal terminal assembly of FIG. 19, taken along lines C—C thereof.

Each of the terminals 81 disposed in the terminal assemblies of this particular embodiment preferably includes an L-shaped terminal that has a contact portion 98 at one end thereof, a tail portion 99 at the other end thereof and an intermediate interconnecting portion 100 that connects the contact and tail portions 98, 99 together. As shown in FIG. 20C, the terminal interconnecting portions are preferably maintained in a selected spacing "DS1" by the body portions 83 and the space between the terminal interconnecting portions 100 is filled with the dielectric material from which the body portion 83 is molded.

FIGS. 18–20C illustrate a male terminal assembly in which the contact portions 98 of the terminals 81 are embedded within the insulative body portion 83, and when combined with the other half of the terminal assembly, two such contact portions are presented for every horizontal row, or level, of terminals. These terminals are connected to a differential signal circuit, meaning that they carry the same magnitude voltage signal but of different polarity, as is known in the art, i.e., +0.5 volts and −0.5 volts. The two differential signal terminals are separated by the insulative body portion, typically molded from a dielectric material so as to provide an optimal spacing to maintain the electrical affinity that differential signals have for each other. Three such pairs of differential signal terminals are shown in each of the signal terminal assemblies of FIGS. 18–19, and each such pair is further spaced apart from each other in the vertical direction, as shown in FIG. 20B.

Figure 21:
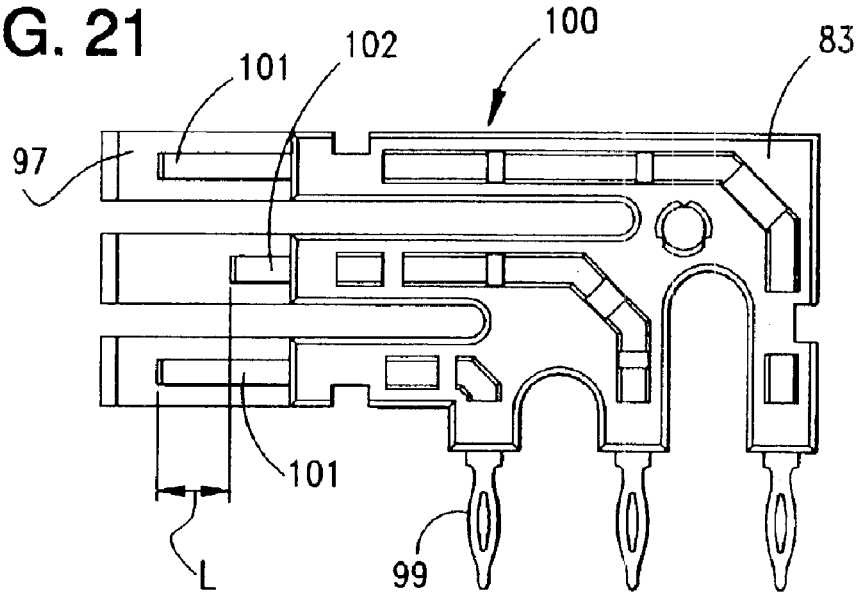
FIG. 21 is an elevational view of a power terminal assembly constructed in accordance with the principles of the present invention and suitable for use in the receptacle connector housing of FIG. 1.

FIG. 21 illustrates a terminal assembly 100 that is suitable for use with power terminals 101 and one of the power terminal pairs 102 (or even a single terminal) is shorter than the rest and its leading edge is moved back from the other terminals to provide a means for indicating the proper mating and engagement (electrically) of the two connector components. This is accomplished by having the lengths of the opposing receptacle terminals, as explained below, be of the same length and one of the pairs will not fully contact each other until the difference in length L is overcome. In other words, the middle power terminal 102 shown in the terminal assembly of FIG. 21, will not be contacted until the opposing terminal assembly of an opposing connector is inserted substantially all the way in the facing connector. This difference in length may also be used with signal terminals, and when so used, may be used with status detection circuits for determining when the connectors are mated or unmated.

Figure 22:
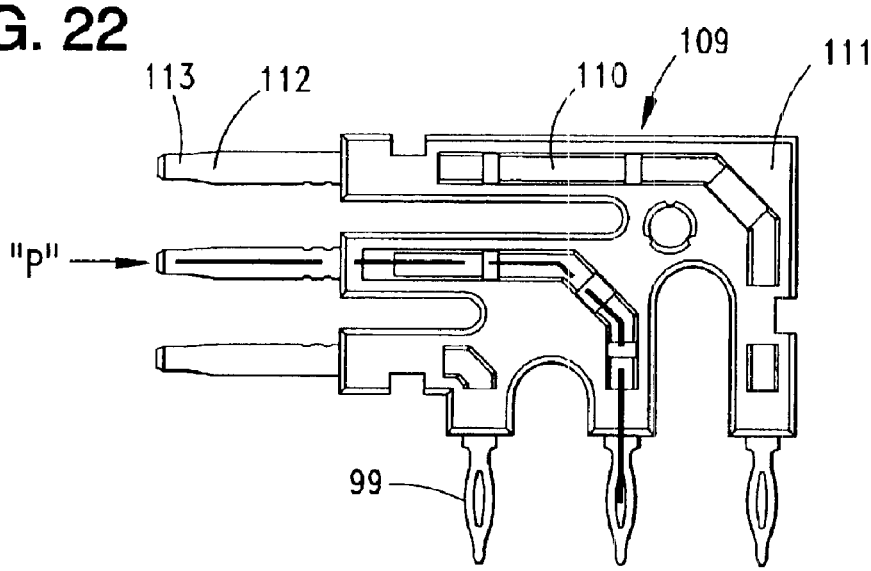
FIG. 22 is a side elevational view of a terminal assembly used for either signal or power terminals in the plug connector housing of FIG. 13.
Figure 23A:
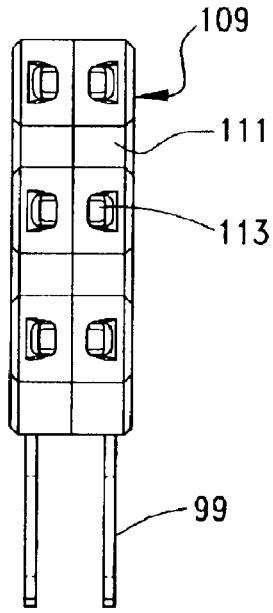
FIG. 23A is a frontal elevational view of the terminal assembly of FIG. 22.
Figure 23B:
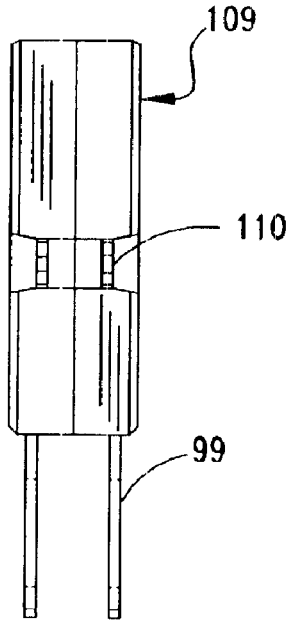
FIG. 23B is a rear elevational view of the terminal assembly of FIG. 22.
Figure 23C:
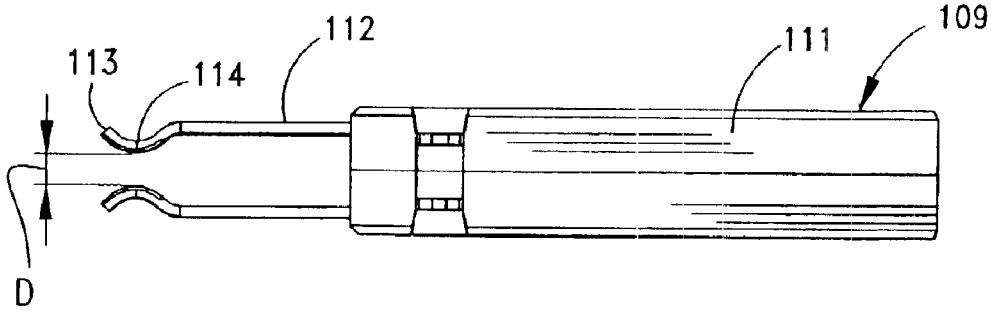
FIG. 23C is a top elevational view of the terminal assembly of FIG. 22.
Figure 24:
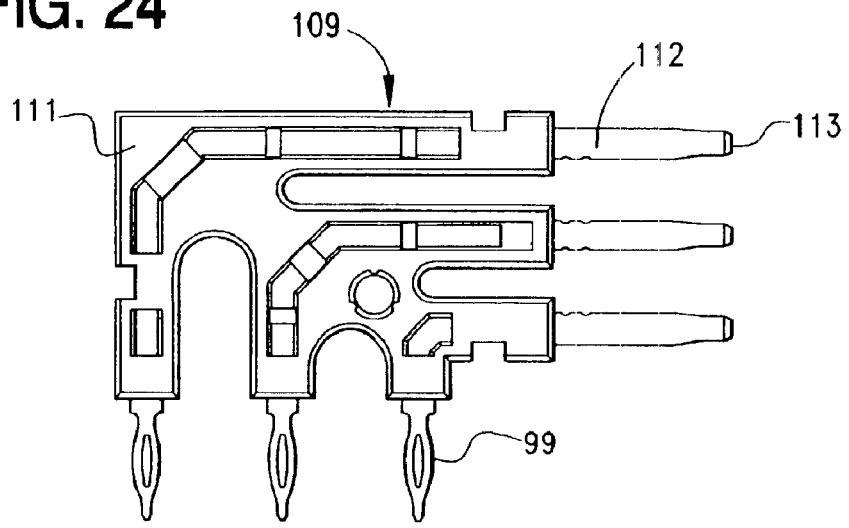
FIG. 24 is an elevational side view of the other side of the terminal assembly of FIG. 22.
Figure 35:
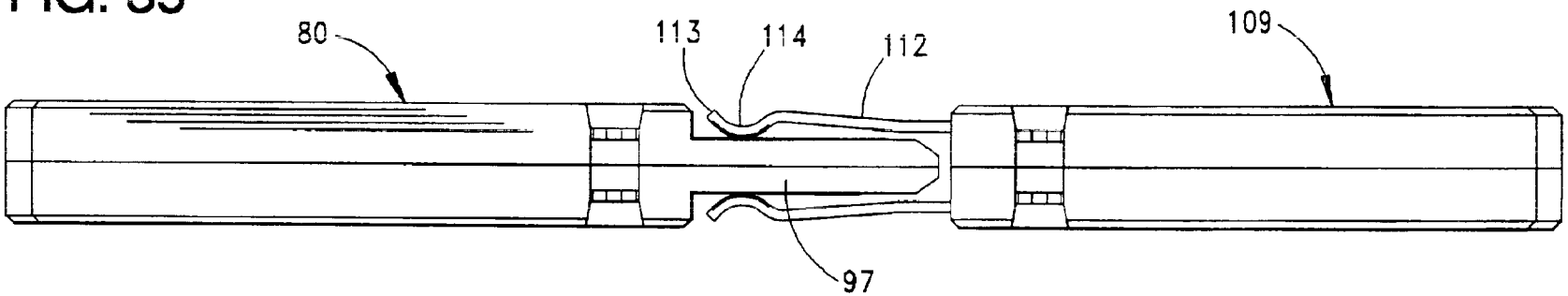
FIG. 35 is a top plan view of two of the terminal assemblies shown in a mated condition.
Figure 36:
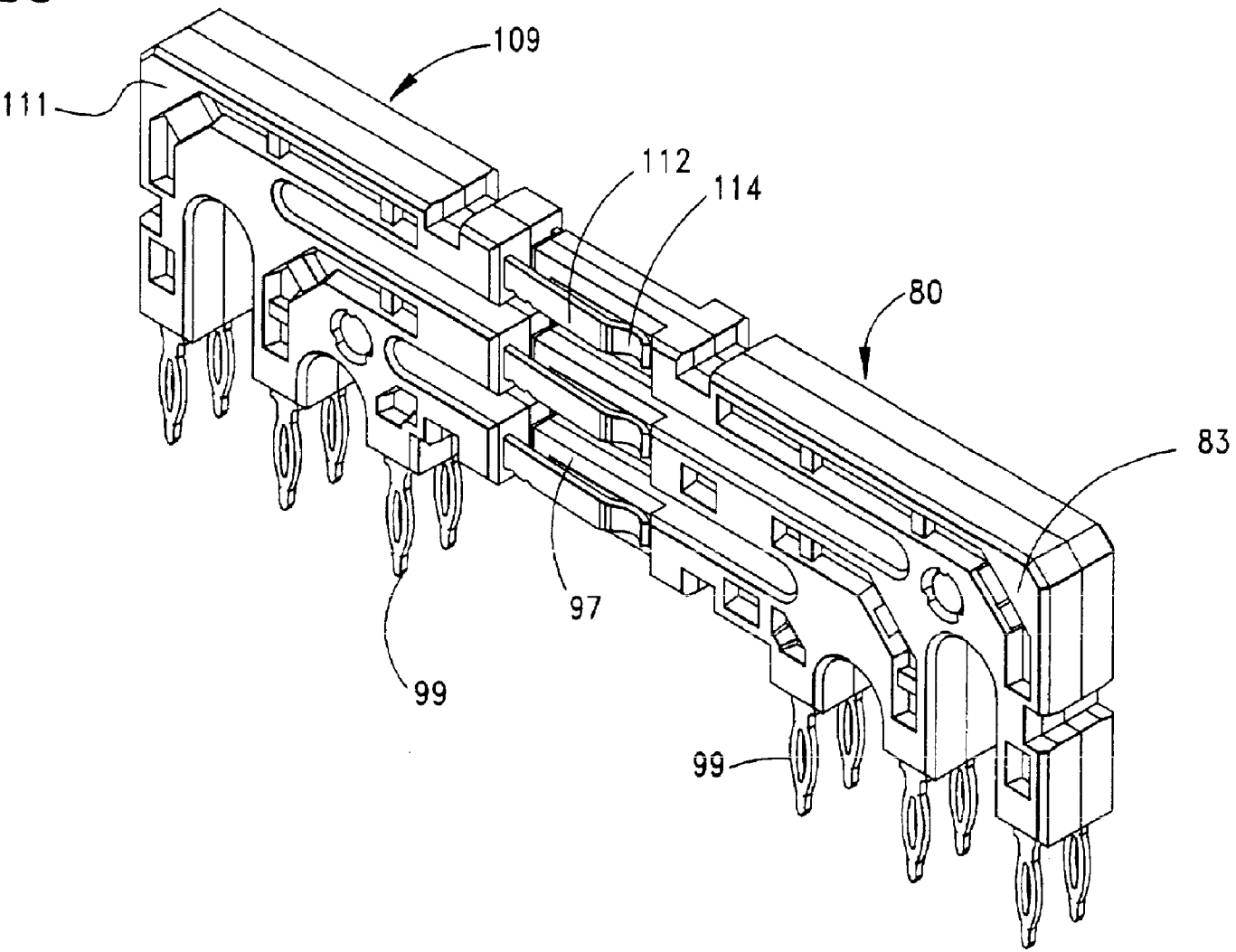
FIG. 36 is a perspective view of the two terminal assemblies of FIG. 25 in their mated condition.

FIGS. 22–24 illustrate various aspects of a receptacle terminal assembly 109 in which conductive terminals 110 are molded into a body portion 111. The terminal contact portions 112 are not embedded in any of the body material, but rather extend outwardly therefrom in a cantilevered fashion as shown to form free ends 113 that are spaced apart from each other, as shown in FIG. 23C. The free ends 113 of the terminals 110 may have curved contact faces 114 formed thereon which are separated by a spacing "D". These free ends 113 slide over the contact ends 97 of the other terminal assemblies 80 and make a reliable electrical contact therebetween. FIG. 33 shows a cross-sectional view of the docking connectors 40, 60 of FIG. 25 for engaging two spaced apart circuit boards 31, 34 with the terminal assemblies 80, 109 in engagement. It will be appreciated that at least some of the terminal assemblies in connector 40 may be the power terminal assemblies 100 shown in FIG. 21 in which some of the terminals, such as terminal 102, are shorter. FIGS. 35 and 36 further illustrate the engagement of terminal assemblies 80, 109. Terminal assemblies 80, 100 preferably have wedge-shaped nose portions 97 that will slidingly separate the curved contact faces 114 of terminals 112 of the receptacle terminal assembly 109 as connectors 40, 60 and terminal assemblies 80, 109 are mated together. Thereafter, curved contact faces 114 of receptacle terminal assembly 109 will contact terminals 98 disposed on nose portions 97, which are best seen in FIG. 18. In this manner, three pairs of differential signal pairs are connected together by the compliant terminals 99 of terminal assembly 40 to circuit board 34 in FIG. 25 to three pairs of differential signal pairs by compliant terminals 99 of terminal assembly 60 to circuit board 31. It can be seen that the terminals follow a defined terminal path "P" in their support frames as shown in FIG. 22.

Figure 30A:
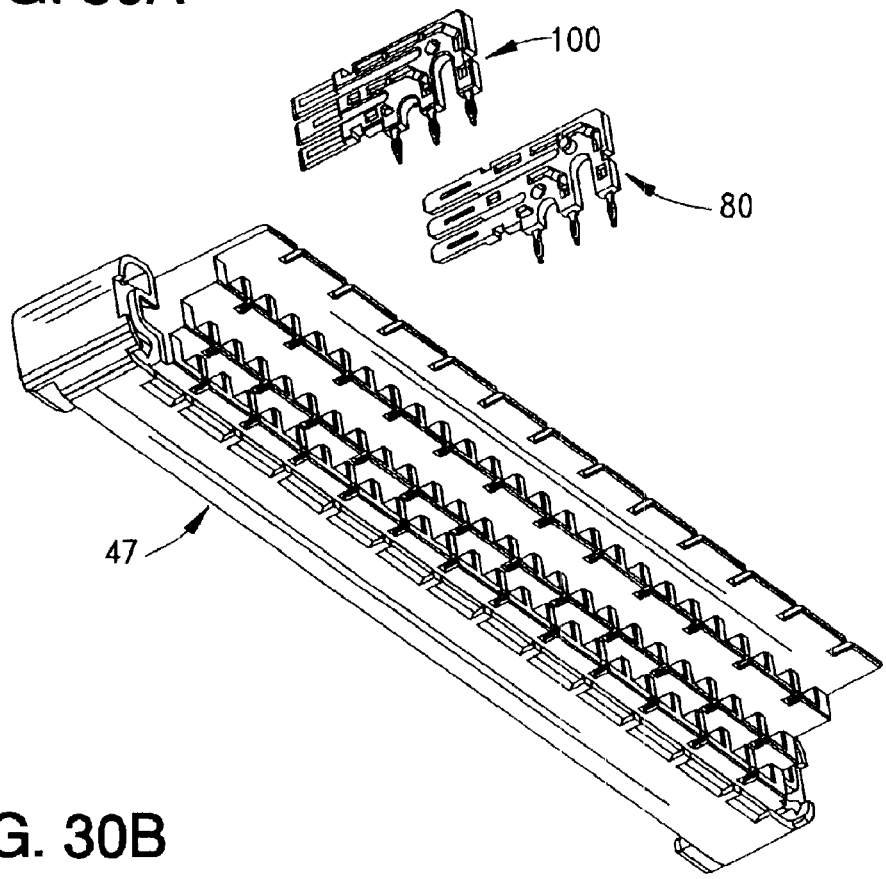
FIGS. 30A–30D are perspective views that sequentially illustrate the steps taken to form one of the plug or receptacle connector components.
Figure 30B:
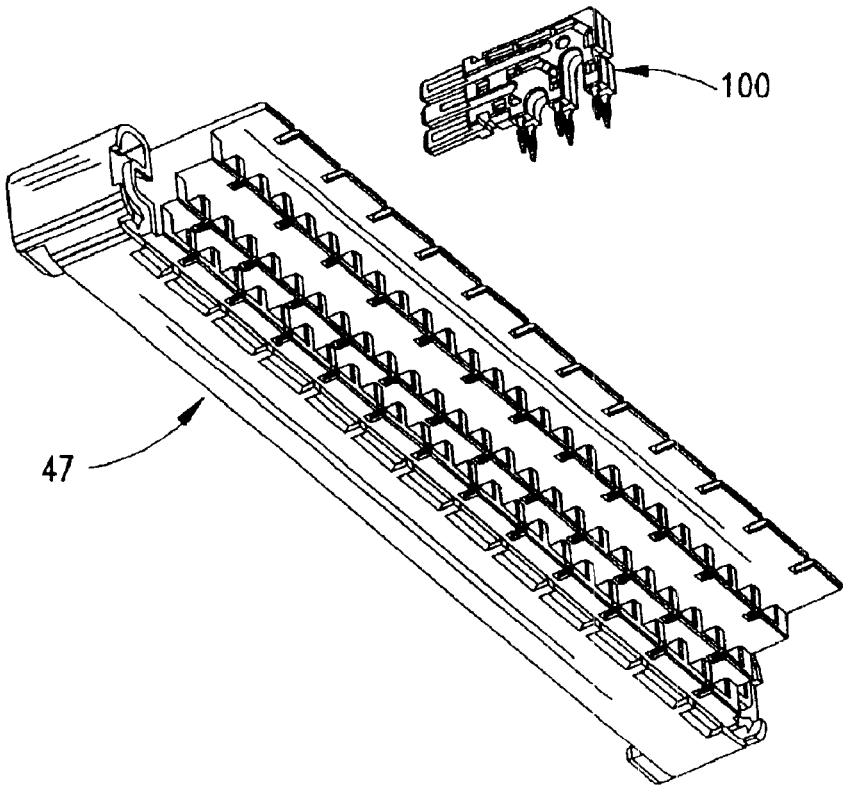
Figure 30C:
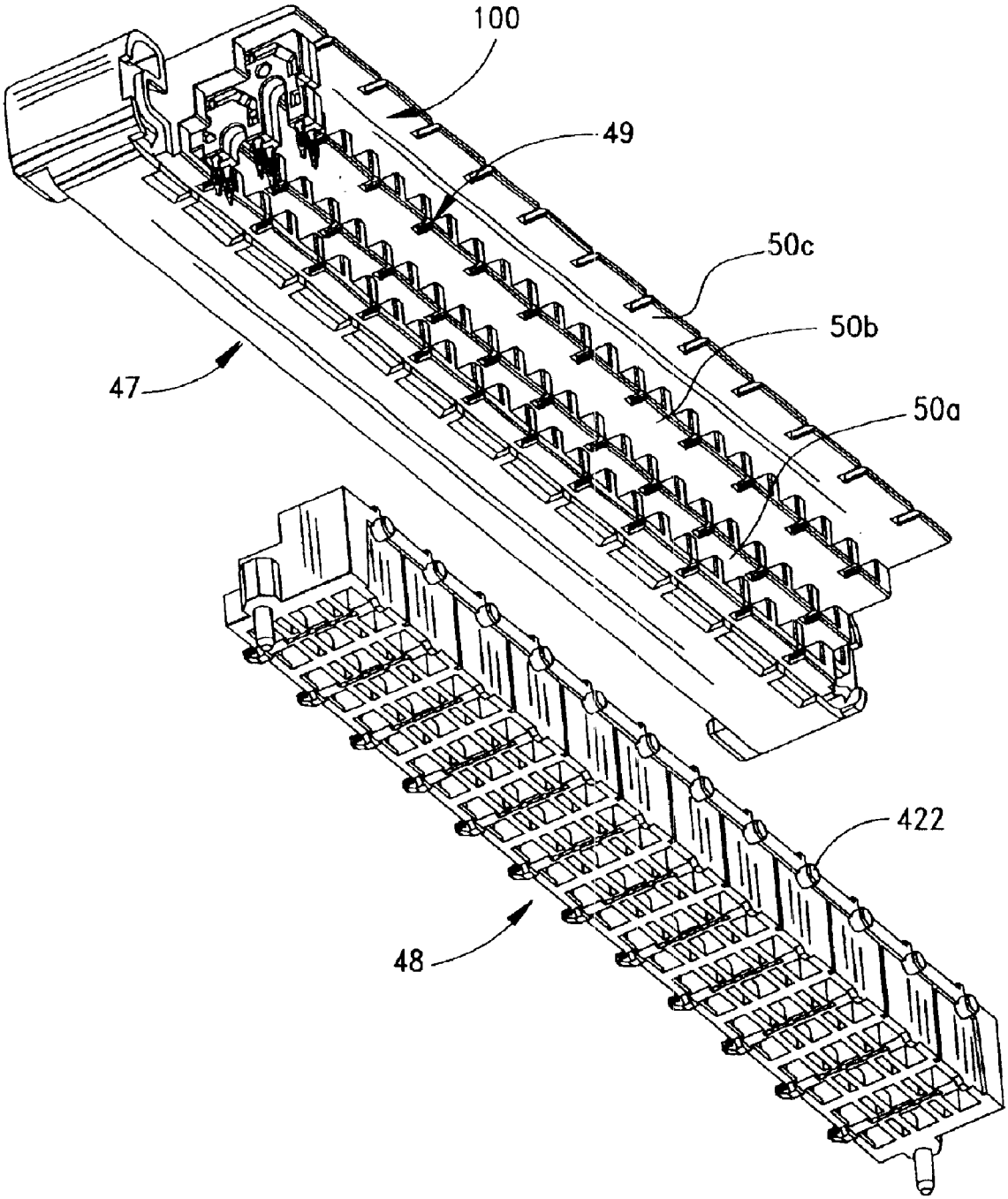
Figure 30D:
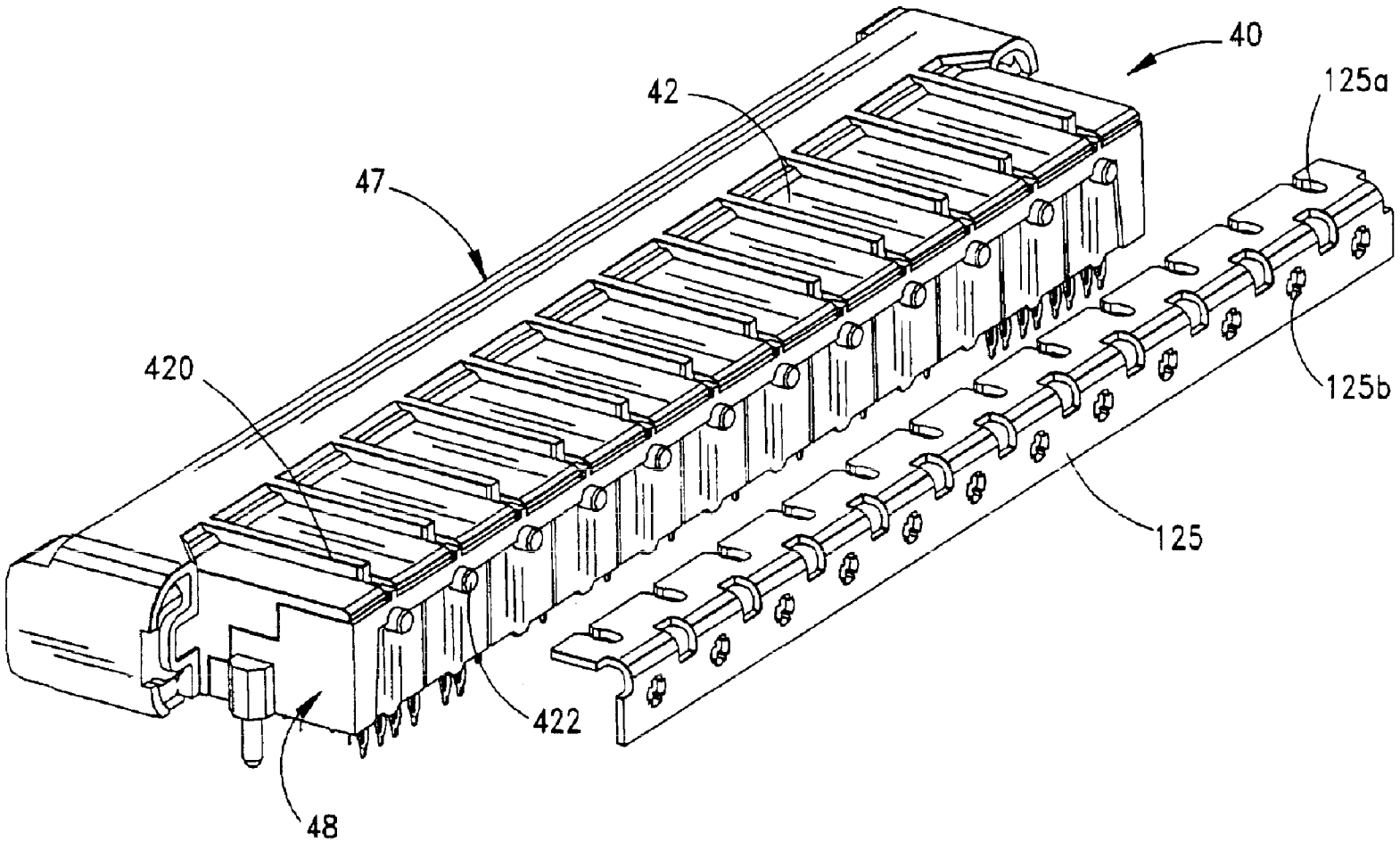

FIGS. 30A–D illustrate the assembly sequence of the connector components of the invention. First of all, the terminal assemblies are formed by combining two half frames to form single terminal assemblies in which one or more differential signal terminal pairs are supported. The terminal assemblies are then inserted into the upper housing, with one assembly being received in each of the vertical slots of the upper housing so that the projecting arms of each terminal assembly will extend into and be received by the horizontal cavities of the upper housing. Once all the terminal assemblies 80, 100 are inserted into the individual connector upper housing 47, the lower housing 48 is attached to the upper housing and the terminal assemblies as shown in FIG. 30D. Then a retainer 125 is attached to the connector component and engaged to the upper and lower housings 47, 48.

Figure 26:
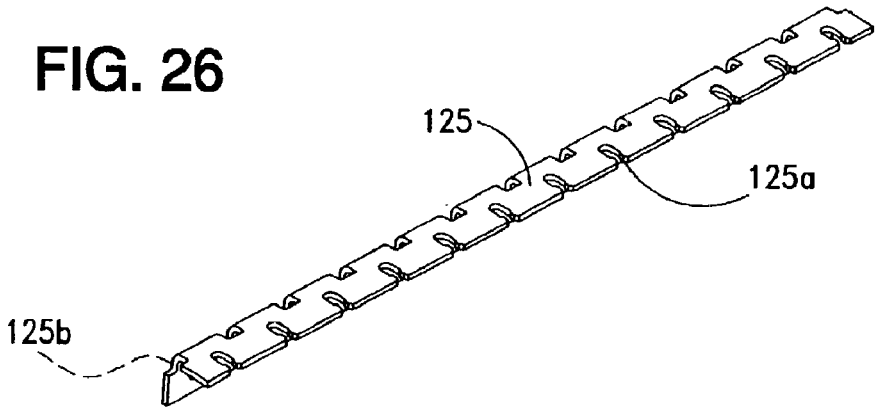
FIG. 26 is a perspective view of a retainer clip used to hold either of the receptacle or plug connector upper housings to their associated lower housings.

As illustrated in FIG. 26, the retainer 125 includes an angled member that extends for approximately less than the width of the upper and lower connector housings of the two connectors 40, 60. A series of slots 125*a* are formed along one edge of the retainer 125 and these slots engage either ribs 420 (FIG. 1) or lugs 421 (FIG. 13), both of which are disposed on the top of the upper connector housing components of the two connector members 40, 60. A series of openings 125*b* are formed in the opposite side of the retainer 125 and these openings fit over and engage complementary-shaped posts 422 that are formed along the back wall of the connector component lower housings as shown in FIG. 30D.

FIG. 31 illustrates the electrical isolation of the differential signal pairs obtained by the present invention. In the mating interface, each differential signal pair is held within an enclosure of at least four walls of each of the two connector components for a significant extent of the path P of the differential signal pair. Because the walls of the cavities 49 are plated with a conductive material, they will serve to define a ground that encompasses each differential signal pair. This ground serves to isolate each such pair at the mating interface. The openings in the terminal assemblies that expose the terminal interconnecting portions to the ground surfaces of the connector structure assist in tuning the impedance of the differential signal pair, in that they create a plurality of air gaps (with a dielectric constant of about 1.0) between the terminals and the housing conductive walls The ground isolation continues through the connector component through the lower housing portion thereof, where the vertical legs of the terminal assemblies are encompassed on four sides by plated portions of the connector component lower housing, thus obtaining a similar, if not identical isolation as obtained in the mating interface.

Vertical Interposer Structure

Figure 37:
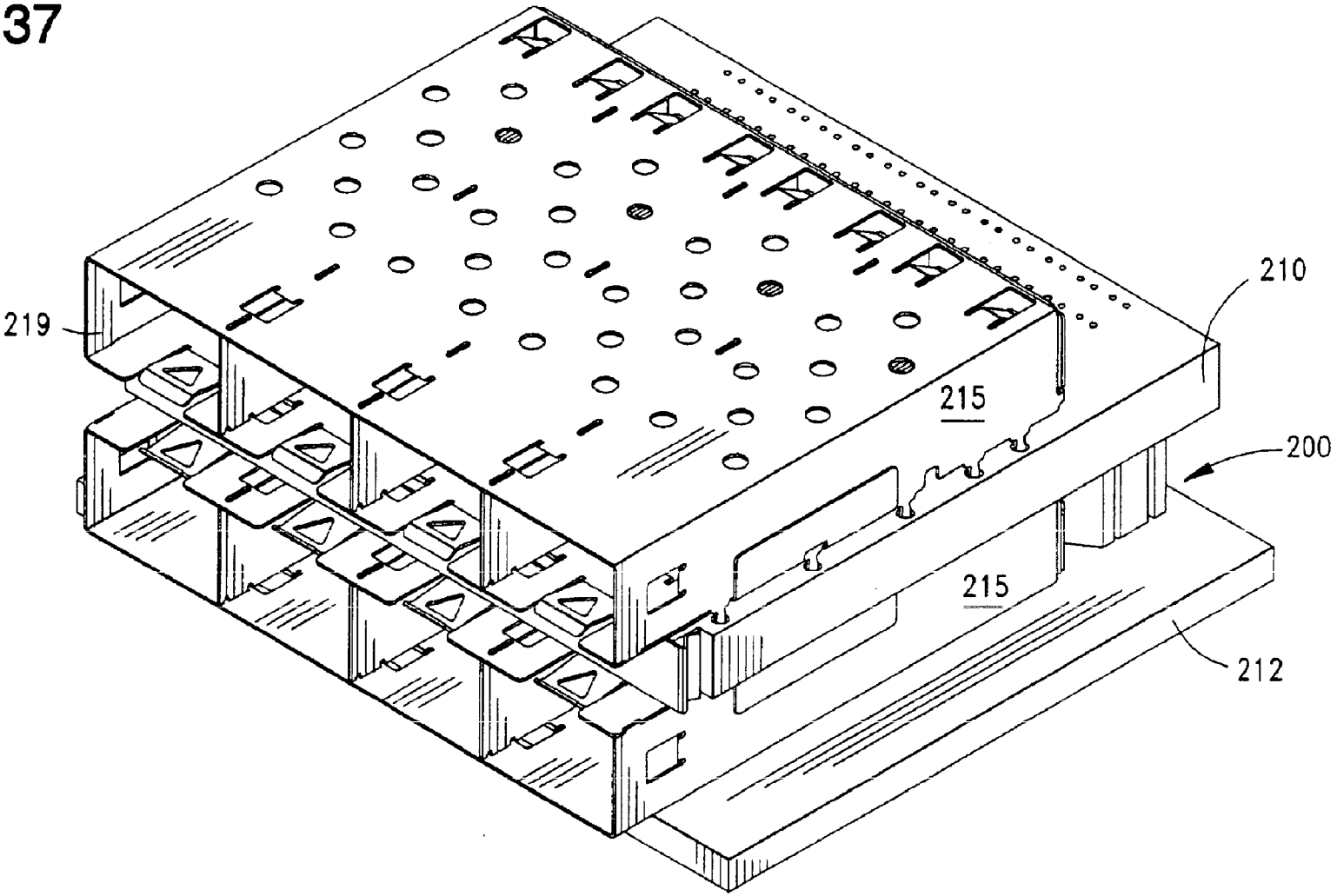
FIG. 37 is a perspective view of an alternate embodiment of a connector constructed in accordance with the principles of the present invention illustrated in place connecting two circuit boards together.
Figure 38:
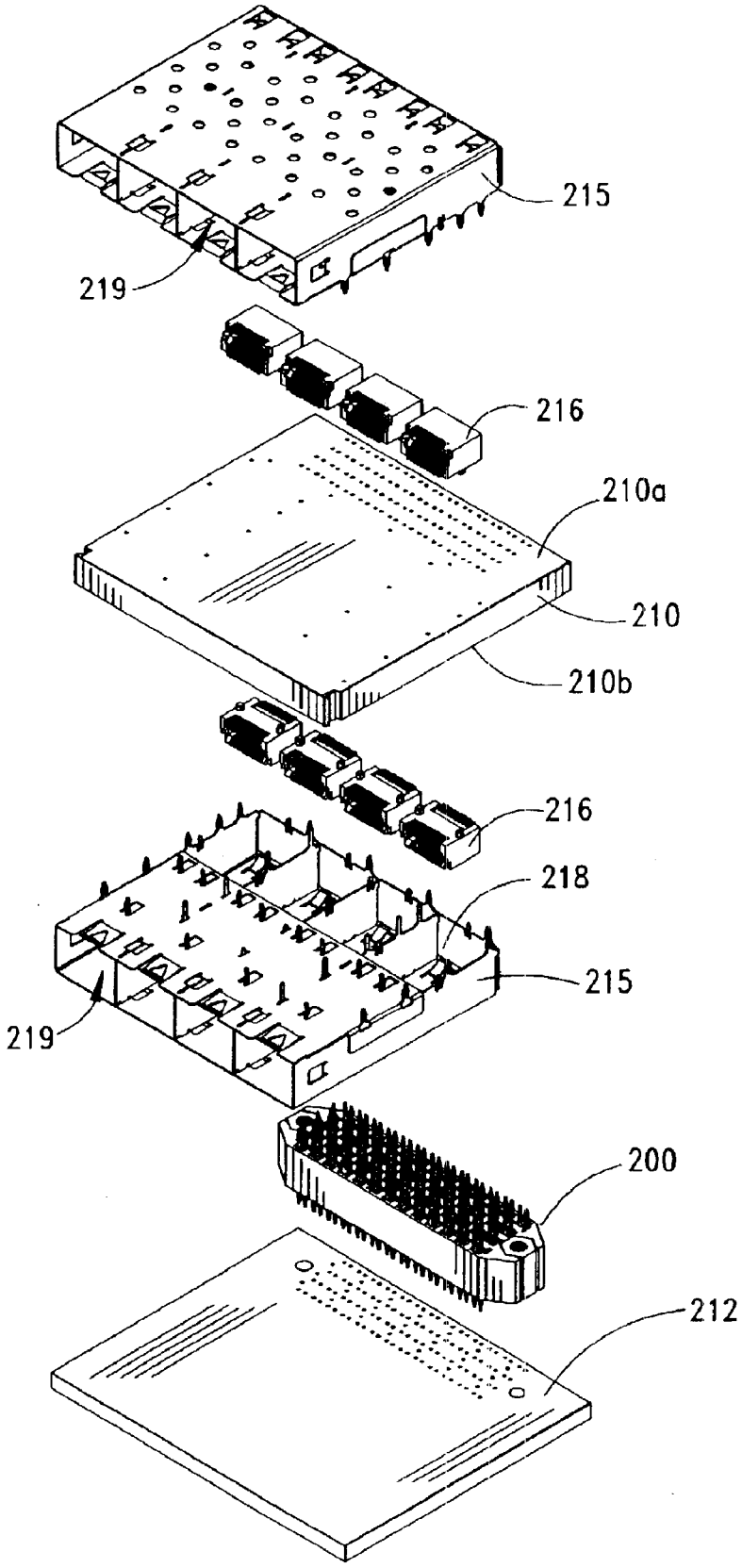
FIG. 38 is an exploded view of the assembly of FIG. 37.

FIGS. 37–38 illustrate another style of connector that is particularly suitable for use in board-to-board applications. This connector 200 is used mostly as an "interposer", or element that extends between and separates two components, in this instance, the two components are circuit boards 210, 212. The connector 200 is shown in use with two ganged shielding cages 215 that are mounted to opposite surfaces of a first circuit board 210.

Card edge connectors 216 are applied to the opposing surfaces 210*a*, 210*b* and fit within openings 218 formed in the shielding cages 215 so as to communicate with hollow passages, or receptacles 219 defined in the cages 215, each of which typically receives a module or adapter such as a GBIC, or the like. In order to connect the circuitry on the first circuit board 210 to circuitry on the second circuit board 212, an interposer connector 200 of the present invention is utilized.

Figure 39:
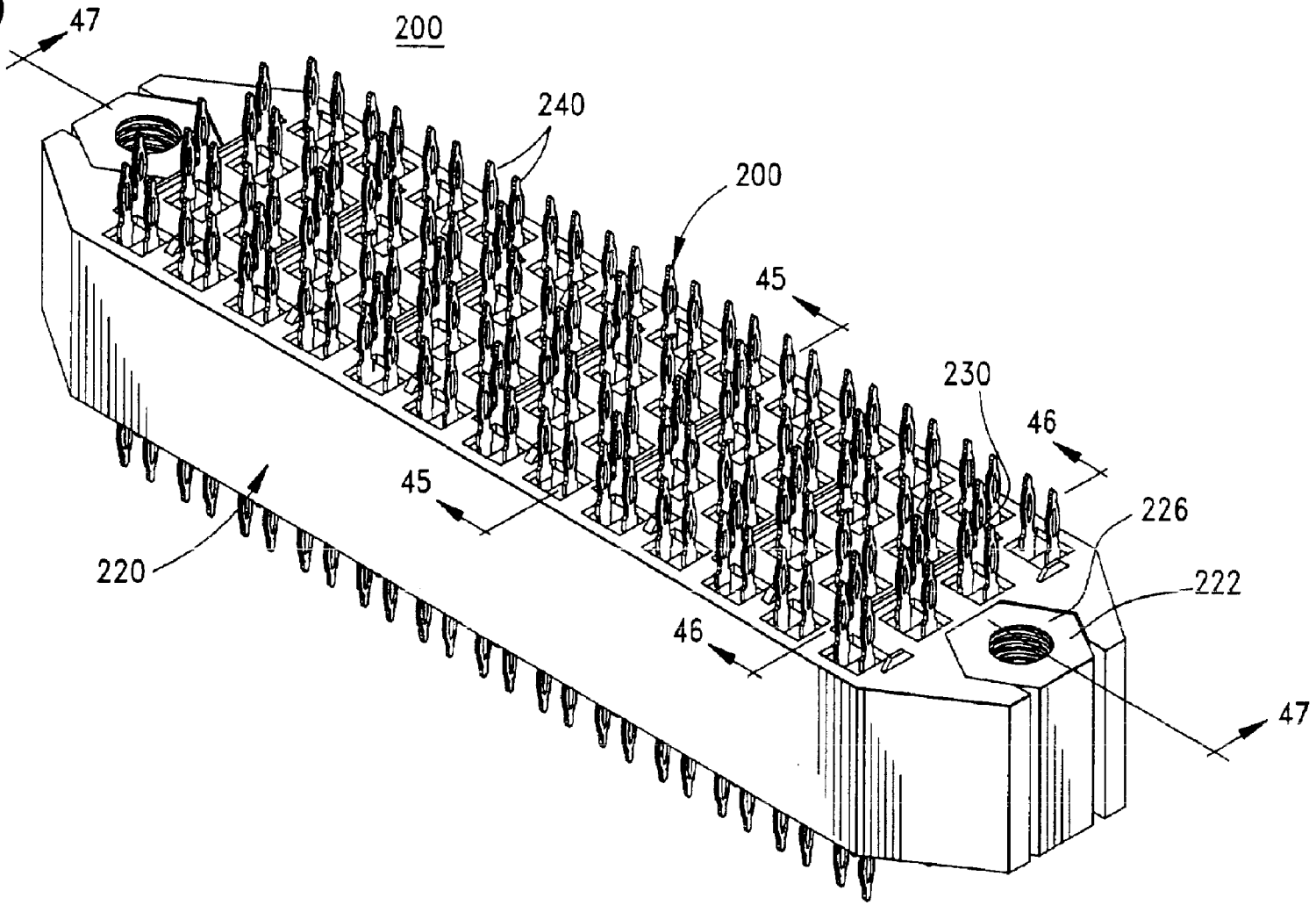
FIG. 39 is a perspective view of the interposer, a board-to-board connector used in the assembly of FIG. 37.
Figure 40:
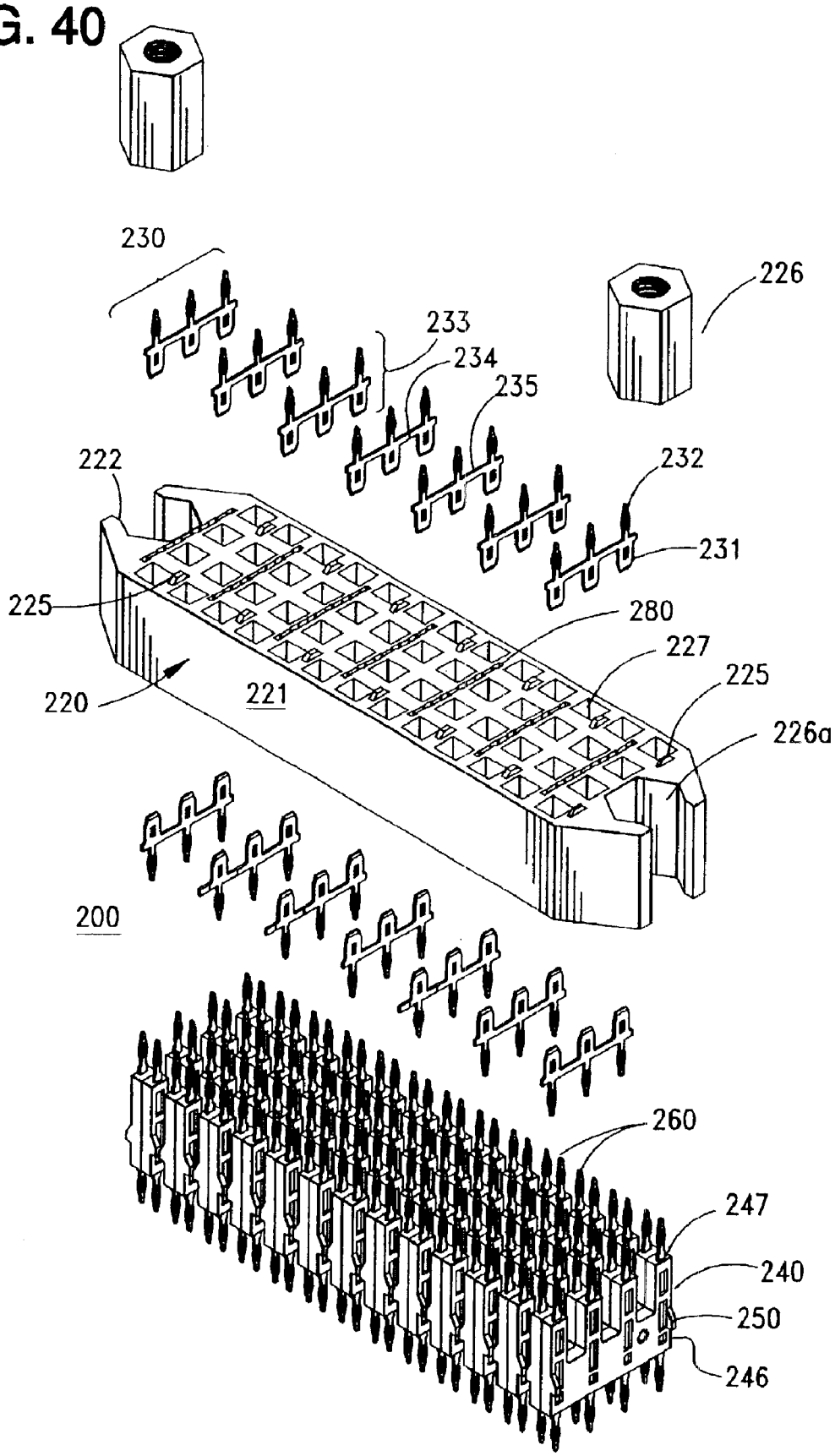
FIG. 40 is an exploded view of the connector of FIG. 37.

Turning to FIG. 39, the connector 200 is separately shown in a perspective view. Connector 200 can be seen to include a supporting housing 220, fastening means 226, signal terminal assemblies 240 and ground connection terminals 230. As illustrated in the exploded view of FIG. 40, the connector housing 220 has an elongated body portion 221 that extends longitudinally between two opposing ends 222 of the housing 220. The housing 220, as shown in the top view of FIG. 42, has a plurality of elongated passages 223 that extend transversely across a centerline "C" thereof. These passages 223 are spaced apart from each other and are separated from each other by intervening walls 224, which may also be considered as extending transversely.

Figure 49:
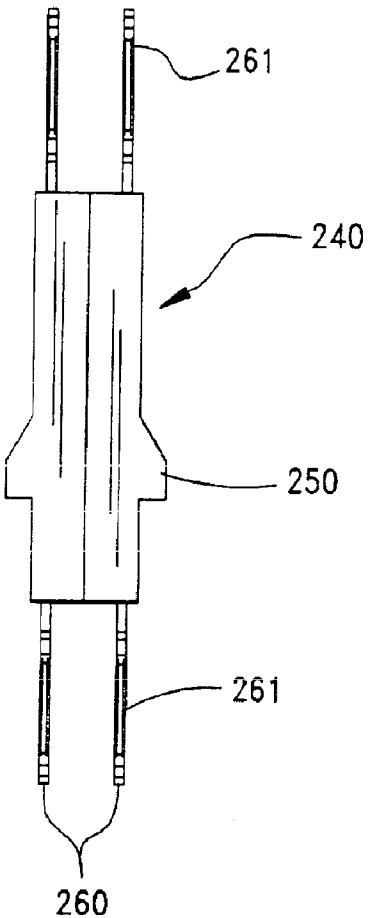
FIG. 49 is a side elevational view of the terminal assembly of FIG. 45.
Figure 50:
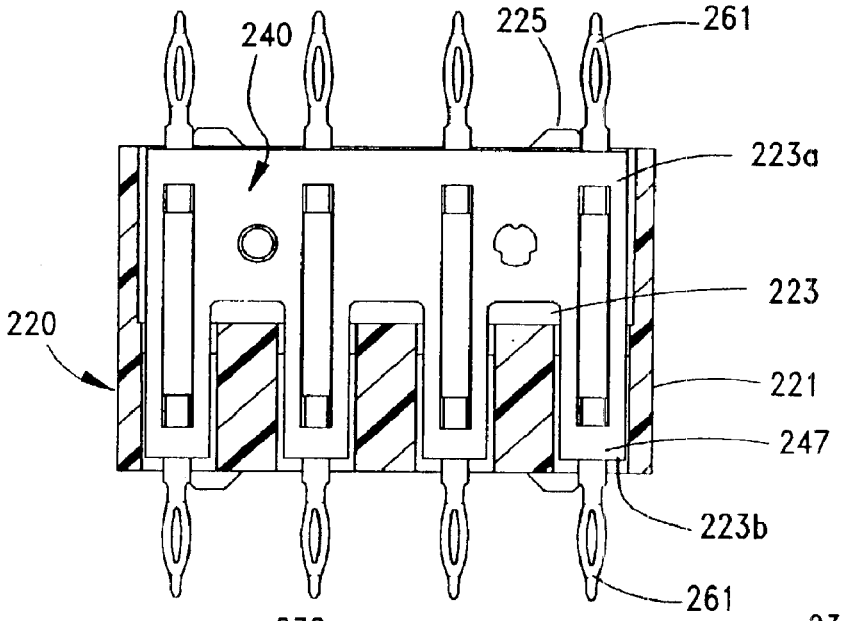
FIG. 50 is a sectional view taken transversely through the connector housing of FIG. 37 along lines 50—50 thereof and illustrating how the terminal assembly fits into the housing.

The passages 223 do not have a uniform configuration through the housing 220. As best seen in FIG. 50, each passage 223 has an elongated hollow base portion 223*a* that transversely extends across most of the width of the housing 220 and a plurality of smaller hollow portions 223*b* that communicate with the larger base portion 223*a* and which may be considered as sub-passages that extend vertically from the base portion. In this example, each of the passages 223 includes a single larger hollow base portion 223*a* and four smaller hollow base portions 223*b*. The passages 223 may be considered as having a general U-shape or E-shape with the base portions 223*a* thereof being the base of the letters and the thin portions 223*b* being the legs of the "U" or the "E". Thus, as shown in the bottom view of the connector housing 220 in FIG. 41, the four sets of legs 247 of each terminal assembly 240 extend into the smaller passages 223*b* such that signal terminals 261 project from the bottom surface of connector housing 220. The signal terminals 261 are arranged in differential signal pairs 260 at the top and bottom surfaces of connector housing 220, as seen in many of the figures including FIGS. 41–43 and 52, and in the figures showing the terminal assemblies, including FIGS. 45 and 48–49.

Figure 47:
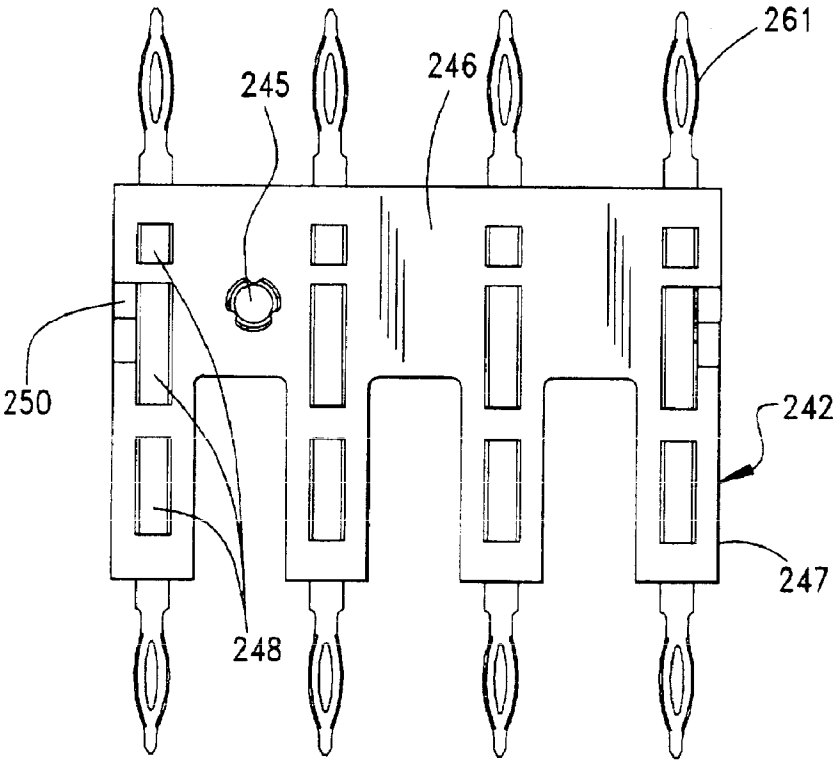
FIG. 47 is a side elevational view of one of the terminal assembly halves of FIG. 45.
Figure 46:
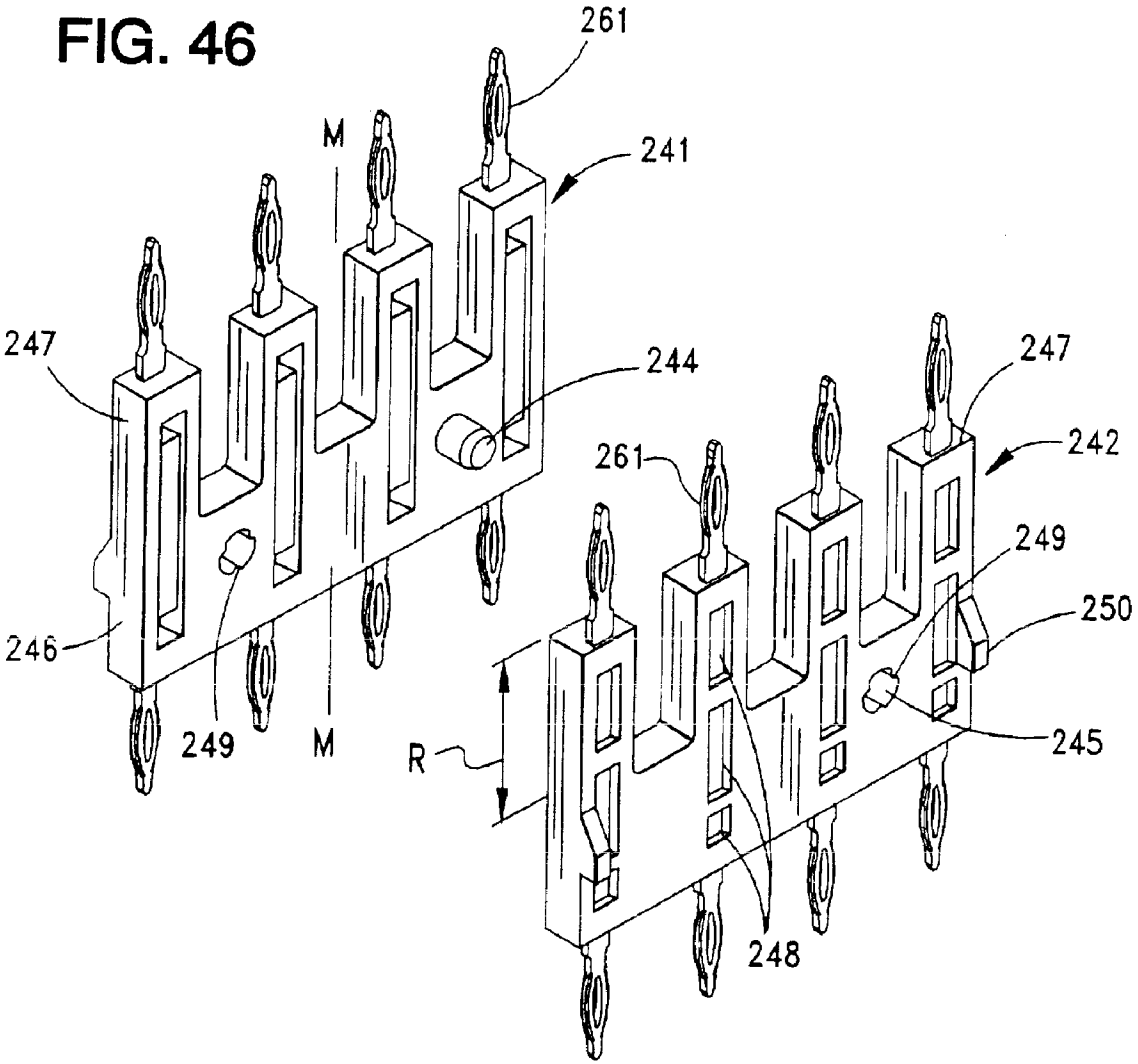
FIG. 46 is an exploded view of the terminal assembly of FIG. 45 showing the two assembly halves before assembly.

As shown in FIGS. 46 and 47, the terminal assemblies have complementary shapes so that they fit in the passages in the manner shown in FIG. 50. Whereas the passages 223 on the bottom of the housing in FIG. 42 have a uniform rectangular appearance, the passages 227 on the top surface of the housing in FIG. 41 have a segmented appearance with four such passages 227 being shown opening to the exterior for each rectangular passage 223. As explained in greater detail below, each such passage preferably contains a single differential signal pair of two associated, conductive terminals.

As with the prior embodiment, all of the exterior surfaces of the connector are preferably covered with a conductive material. One or more portions may be formed with the connector housing in the form of standoffs 225 shown in FIG. 40 that project outwardly and which may serve to hold the connector housing away from the surface of the circuit board. These standoffs may also be plated so that they may be connected to ground traces on the opposing circuit board(s).

In order to provide additional grounding connections, a plurality of ground terminal assemblies 230 are provided. These are similar in size, function and shape to the ground terminals 84 depicted in FIG. 27, and each such assembly 230 includes, as shown in FIG. 35, opposing head portions 231 that are inserted into corresponding slots or openings 280 formed in the top and bottom faces of the connector housing, tail portions 232 that are received within and through hole openings in the circuit boards. The head and tail portions 231 and 232 each constitute a single terminal 233, and sets of these terminals are interconnected by a single interconnecting bar 234. This bar 234 permits the terminals to be singulated, or separated, from a continuous strip of terminals into discrete sets. By joining the terminals together in sets, the need for inserting individual terminals is eliminated.

Figure 41:
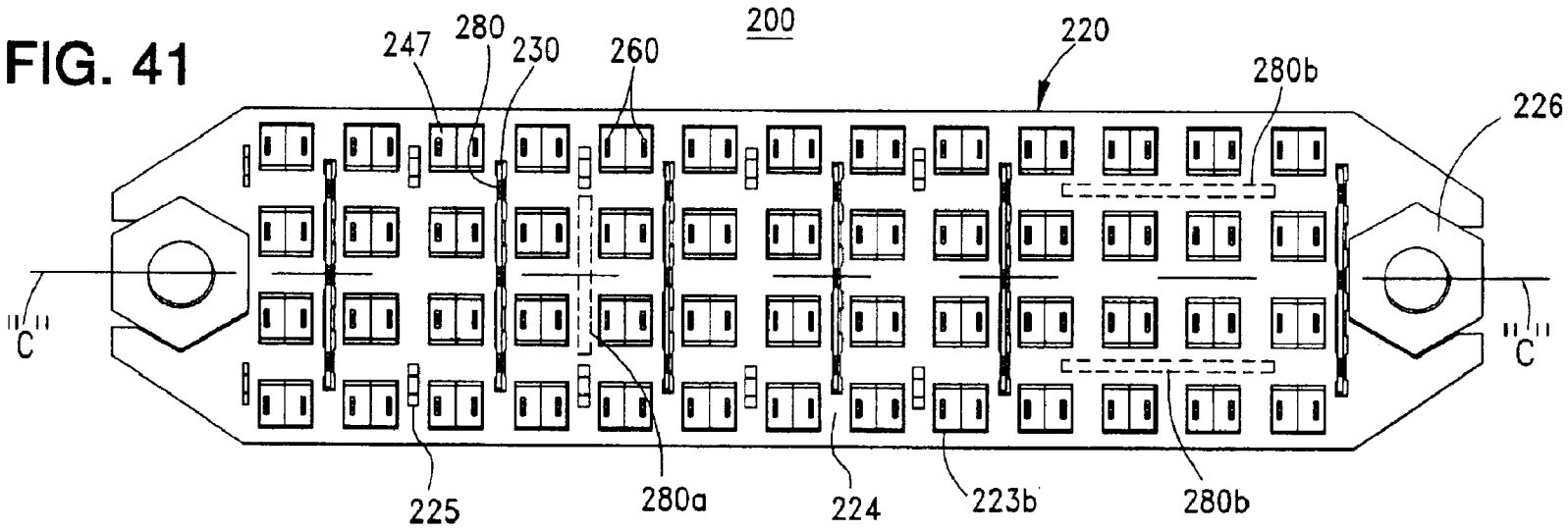
FIG. 41 is a top plan view of connector of FIG. 37.
Figure 42:
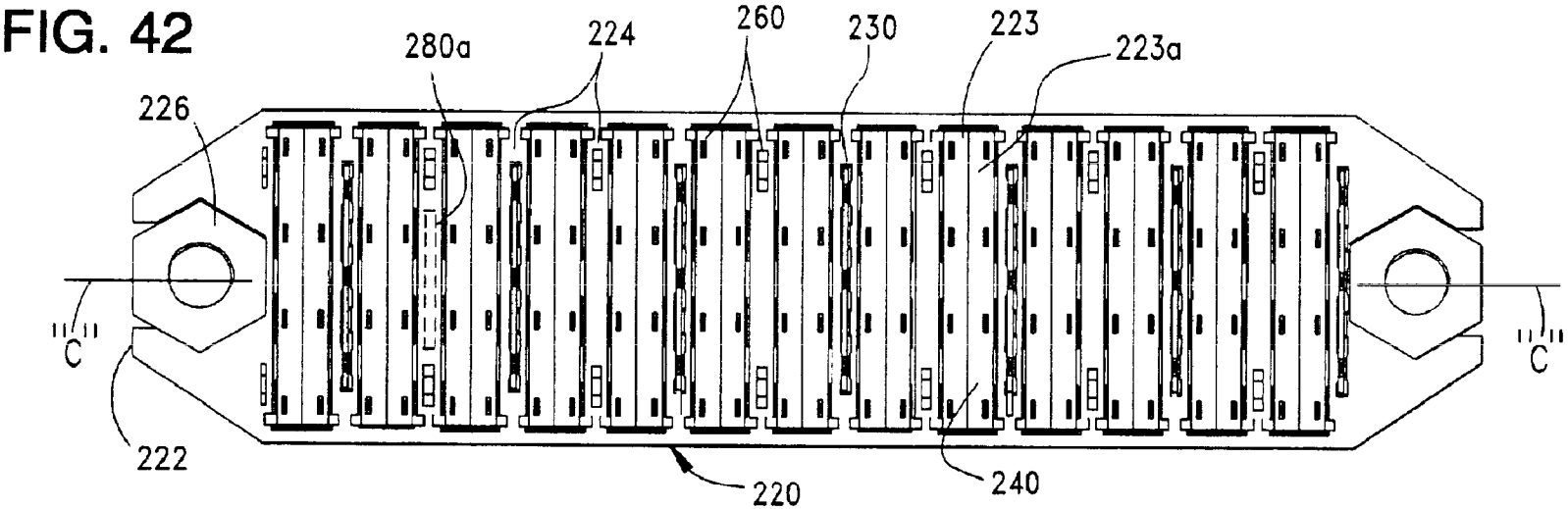
FIG. 42 is a bottom plan view of connector of FIG. 37.
Figure 43:
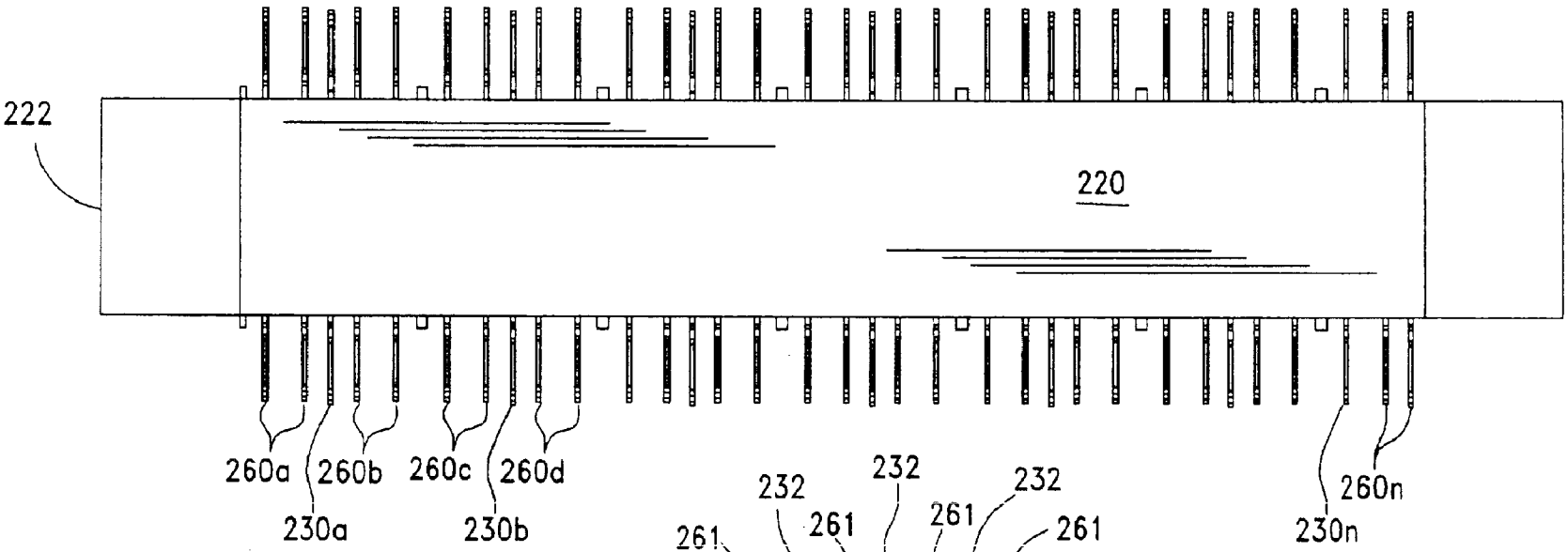
FIG. 43 is a front side elevational view of connector of FIG. 37.
Figure 44:
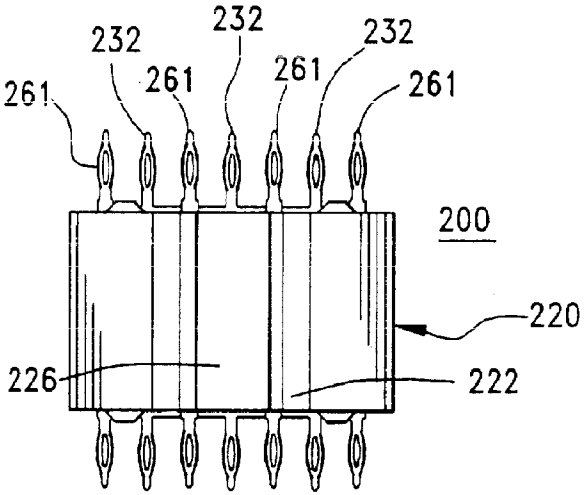
FIG. 44 is an end elevational view of connector of FIG. 37.

In a manner similar to the docking style connector 40, 60, a plurality of transversely extending walls 224 subdivide the housing 220 into a plurality of cavities 223, such as the elongated cavities 223*a* on the side illustrated in FIG. 42 and the smaller rectangular cavities 233*b*. As described below, a terminal assembly 240 with a plurality of differential signal pairs is inserted into cavities 223*a*, with one differential signal pair disposed in each of cavities 223*b*. In this example of FIGS. 37–52, slots 280 are provided in every other transverse wall 224 for receiving a ground terminal assembly 230 therein. These conductive ground terminals 230 are shown in greater detail in FIG. 51. The ground terminals 230 serve to connect both side of interposer connector 200 to ground circuits and planes of the circuit boards 210, 212 shown in FIG. 37.

Figure 51:
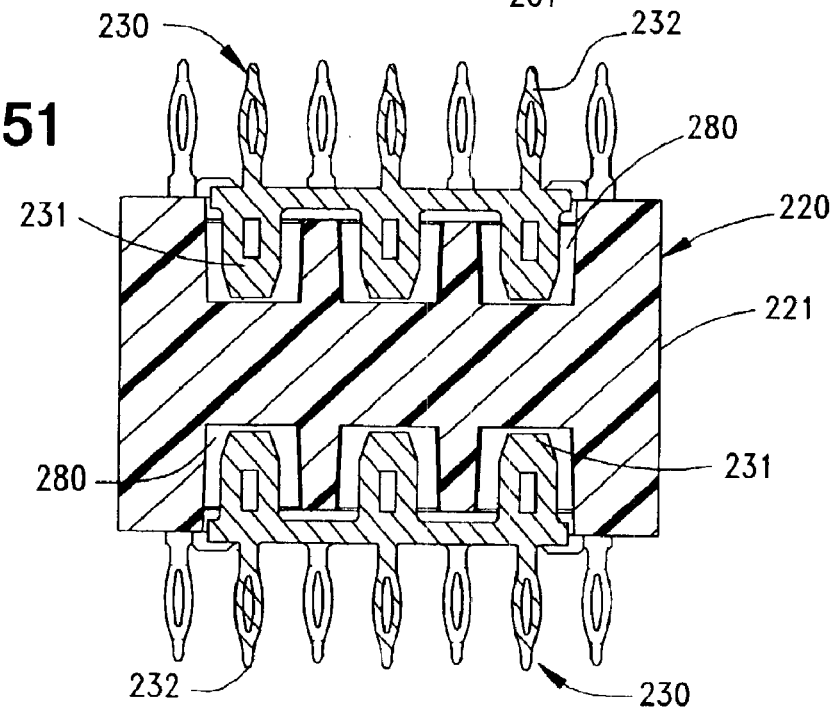
FIG. 51 is a sectional view taken transversely through the connector housing of FIG. 37 along lines 51—51 thereof and illustrating how the ground members fit in the housing.

The structure of these ground terminals 230 is shown in FIG. 51, and each terminal 232 includes a retention portion 231 and a terminating portion 261. The retention portion 231 of each such terminal preferably includes a pair of planar heads, which are indented, or dimpled, to form a projecting part on one side of the head to provide an interference fit with the ground terminal receiving slot 280. Compliant pins 232 are preferably of the eye of the needle variety as discussed above with respect to ground terminal assembly 84, which includes a center opening surrounded by deformable sidewalls of the tail, as is known in the art.

When ground terminals 230 are inserted into slots 280 of transverse walls 224, as shown in the examples of FIGS. 12A and 31B, each ground terminal assembly 230 will be adjacently disposed to differential signal pairs 260 located in channels 223, including channels 223*a*, 223*b*. Preferably, the ground terminals 232 are not aligned with the rows and columns defined by the differential signal terminals 260, but are instead disposed at an intermediate or diagonal position between the differential signal terminals 260. Thus, in the examples of FIGS. 41–42, each of three ground terminals 232 on the ground terminal assembly 230 will be located approximately equidistant from four differential signal pairs 260. The ground terminal assemblies 230 will also subdivide the differential pairs into blocks or groups of eight. Of course, as shown in FIGS. 41–42, additional slots 280*a* could be provided in every transverse wall 224, such that the terminal assemblies would subdivide the differential signal pairs into rows of four, if so desired. Since the terminals 232 of the ground terminal assemblies 230 will connect to ground circuits or planes in circuit boards 210, 212, the ground terminals will provide an affinity for differential signals in adjacent differential signal pairs 260 through the interfaces on both side of interposer connector 200 and the associated circuit boards. This will serve to provide a lower impedance across the connector to circuit board interfaces for the differential signals, and will also avoid discontinuities in impedance thereacross.

Of course, the ground terminal assemblies 230 could alternatively be arranged along the longitudinal walls of the housing 220 in slots 280*b*, instead of on the transverse walls 224, as shown in FIG. 41. As with the illustrated embodiment, it would be preferable to have the ground terminal assemblies disposed adjacently to sets or groups of differential signal pairs 260. In yet another possible variation of the disclosed embodiment, the ground terminal assemblies 230 could be disposed on both the transverse and longitudinal walls of the housing 220 adjacently to sets or groups of differential signal pairs 260.

Figure 45:
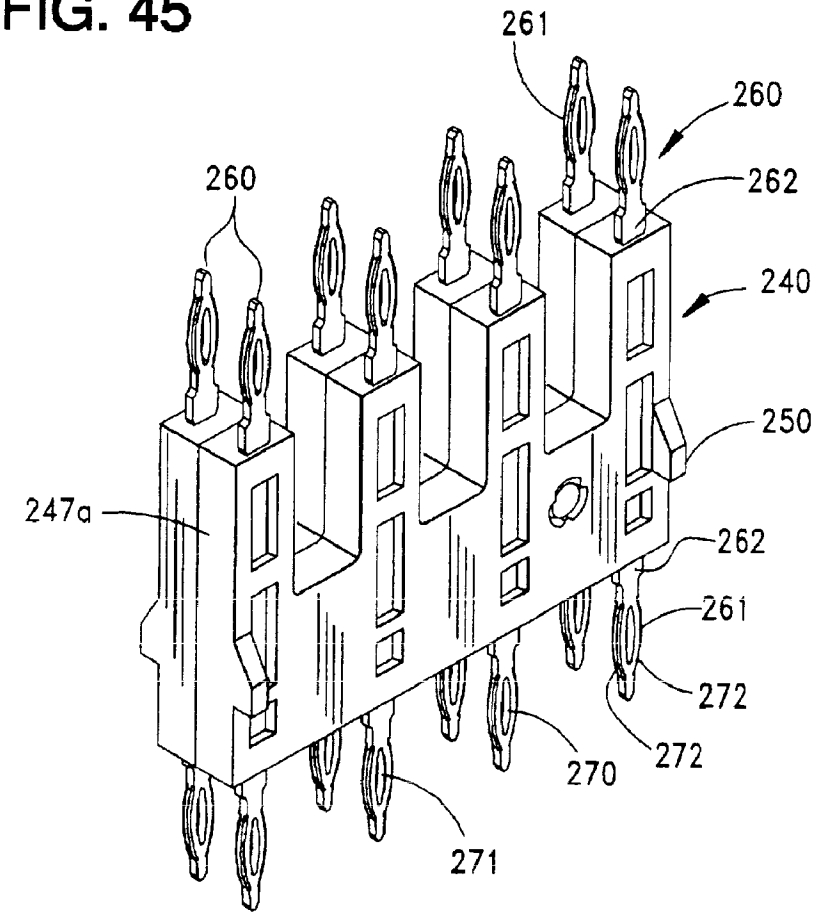
FIG. 45 is a perspective view of a terminal assembly used in connector of FIG. 37.
Figure 48:
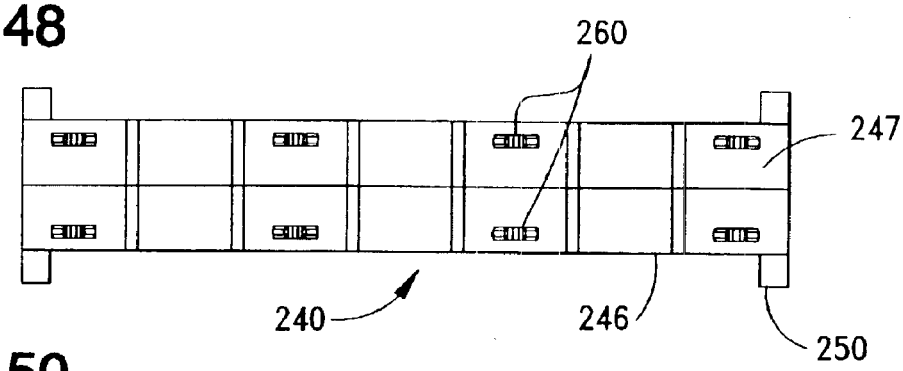
FIG. 48 is a top plan view of the terminal assembly of FIG. 45.

FIG. 45 illustrates a terminal assembly 240 that is received within one of the passages 223 of the connector housing. This assembly may be formed from two halves 241 and 242, as shown in FIG. 46, that are press fit together to form the single terminal assembly 240 of FIG. 45. In this example, the two terminal assembly halves 241, 242 are identical to each other. FIG. 48 illustrates a top view of the terminal assembly 240 in its assembled form, and FIG. 49 illustrates a corresponding side view. It will be understood that the terminal assemblies 240 may be formed as a single piece assembly but that the use of two interengaging halves 241 and 242 may facilitate manufacturing and assembly. Each assembly half 241 and 242 includes a suitable first engagement means, shown as projecting posts 244 and openings 245. These engagement members are preferably located as shown on the opposite sides of a centerline M of the terminal assembly halves.

Each terminal assembly half 241 and 242 further has a wide body or base portion 246 that has a width generally equal to the width of the connector passage 223 in which the formed assembly is received. Individual leg portions 247 are joined to the body portions 246, preferably by way of integrally molding the two portions as a single piece. These leg portions 247 may also be considered as vertical extensions of the body or base portion 246, in order to partially encase each terminal 261 in an electrically insulative material, such as a plastic and preferably a dielectric material. In order to provide tuning of the impedance between associated differential signal terminal pairs, the terminal assembly base and extension portions 246 and 247 may include recesses 248 that are formed therein to define air-containing cavities that are aligned with the terminals. In this manner, the impedance of the differential signal pairs may be easily tuned. When the terminal assembly halves 241 and 242 of FIG. 46 are combined as shown in FIGS. 45, 48 and 49, each terminal assembly leg portion 247*a* contains, or houses, a single differential signal terminal pair, such as the pair 260 shown in the terminal assembly 240 of FIGS. 45, 48 and 49.

Figure 52:
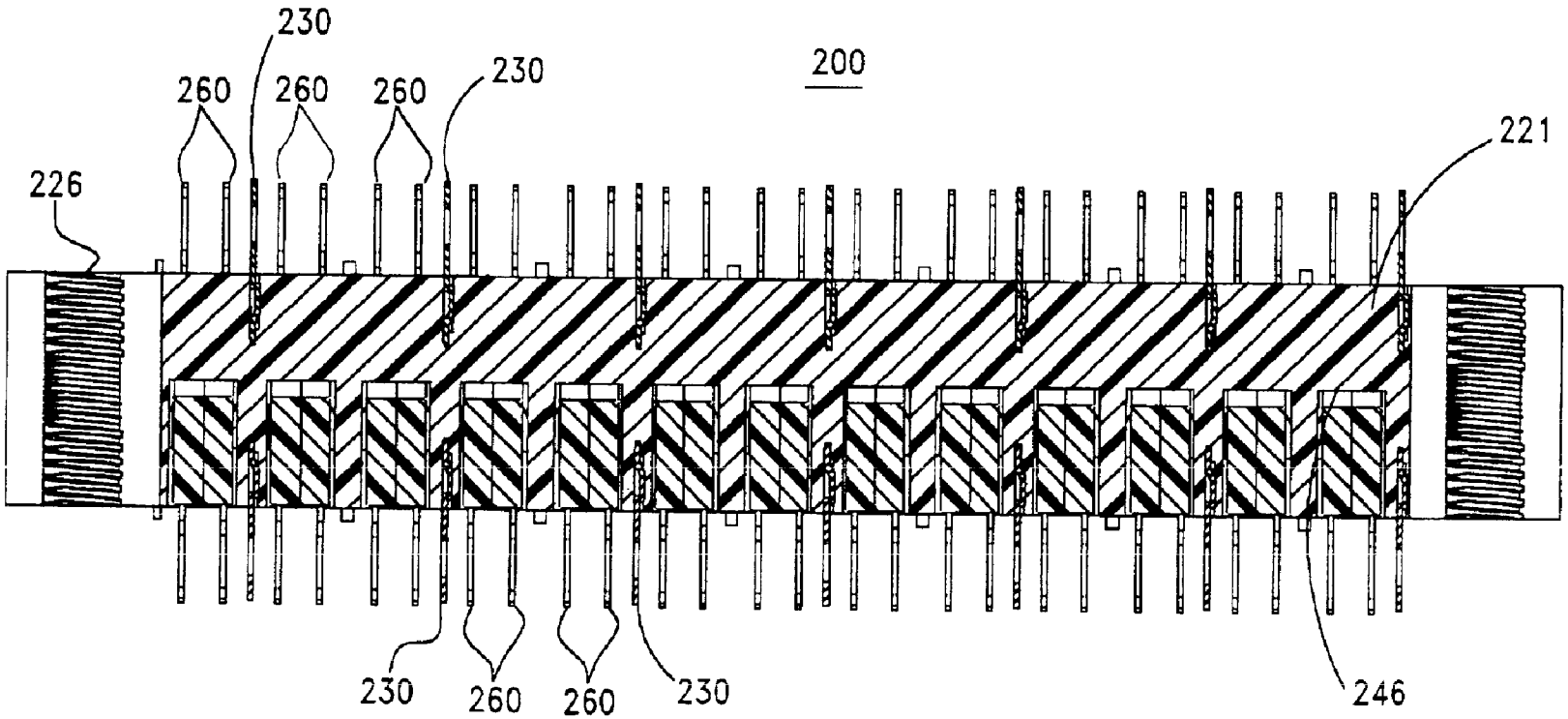
FIG. 52 is a longitudinal sectional view through the connector housing of FIG. 37 taken along lines 52—52 thereof.

As seen in cross-sectional view of FIG. 52, when the terminal assemblies 240 are assembled in connector 200, the differential signal pairs 260 extend vertically from the top side to the bottom side of connector 200, and ground terminals 230 are disposed between every second set of differential signal pairs. An advantage of the symmetrical design of the terminal assembly 240 is that it may be inserted into connector housing 220 without concern for its angular orientation, e.g., whether it is at 0° or at 180° to the corresponding passages 223, 227. Of course, ground terminals 230 could alternatively be disposed between each pair of differential signal pairs, if so desired.

The engagement opening 245 of the terminal assemblies 240 may include internal ribs 249 to maintain a reliable, interference fit with the mating post 244. The front and rear faces of each terminal may include engagement arms, or wings 250 which press against the inner walls of the housing passages. Both such arms are preferably located along the terminal assembly base portion 246. The terminal assembly extension leg portions 247 have a preselected height R as shown in FIG. 46 around which each differential signal terminal pair is surrounded by the conductive exterior surfaces that are present along the interior of the housing passages 227 shown in FIG. 40.

The head portions 231 of the ground terminal sets 230, as shown in FIG. 51, extend into the housing in their slots 280 in the areas between the terminal body portions, such that ground terminals 232 project upwardly from the top surface and downwardly from the bottom surface of the connector housing 220.

With reference to FIG. 45, each differential signal pair 260 is provided with a pair of tail portions 261 that are interconnected by an intervening body portion 262, most of which is supported within the outer insulative material of the terminal assembly 240. The tail portions 261 preferably include an eye of needle structure 270, known in the art, in which a hole 271 is punched in the terminal body to form two thin legs 272 that are slightly bowed outwardly. The tail portions 261 thus provide compliant electrical terminals on both sides of the connector 200.

Nested Interposer Connector Structure

Figure 53:
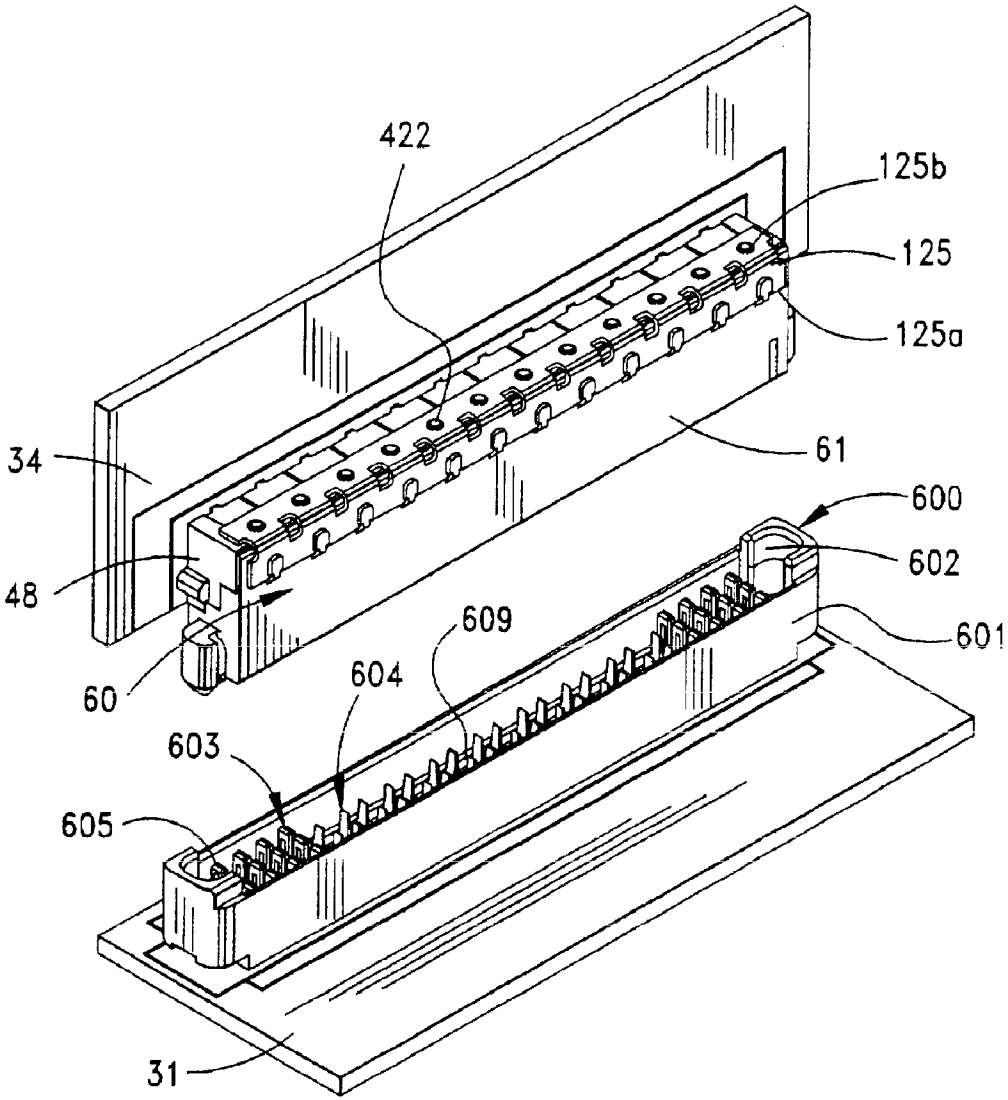
FIG. 53 is a perspective view of an alternate, vertical embodiment of connectors of the present invention.
Figure 55:
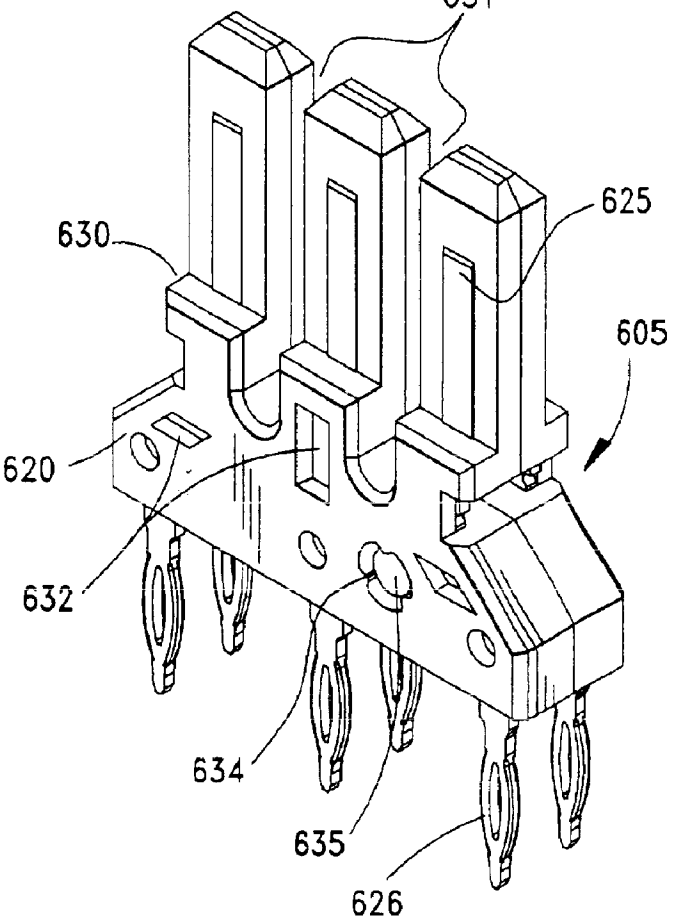
FIG. 55 is a perspective view of a terminal assembly used in the connector of FIGS. 54 and 55.
Figure 54:
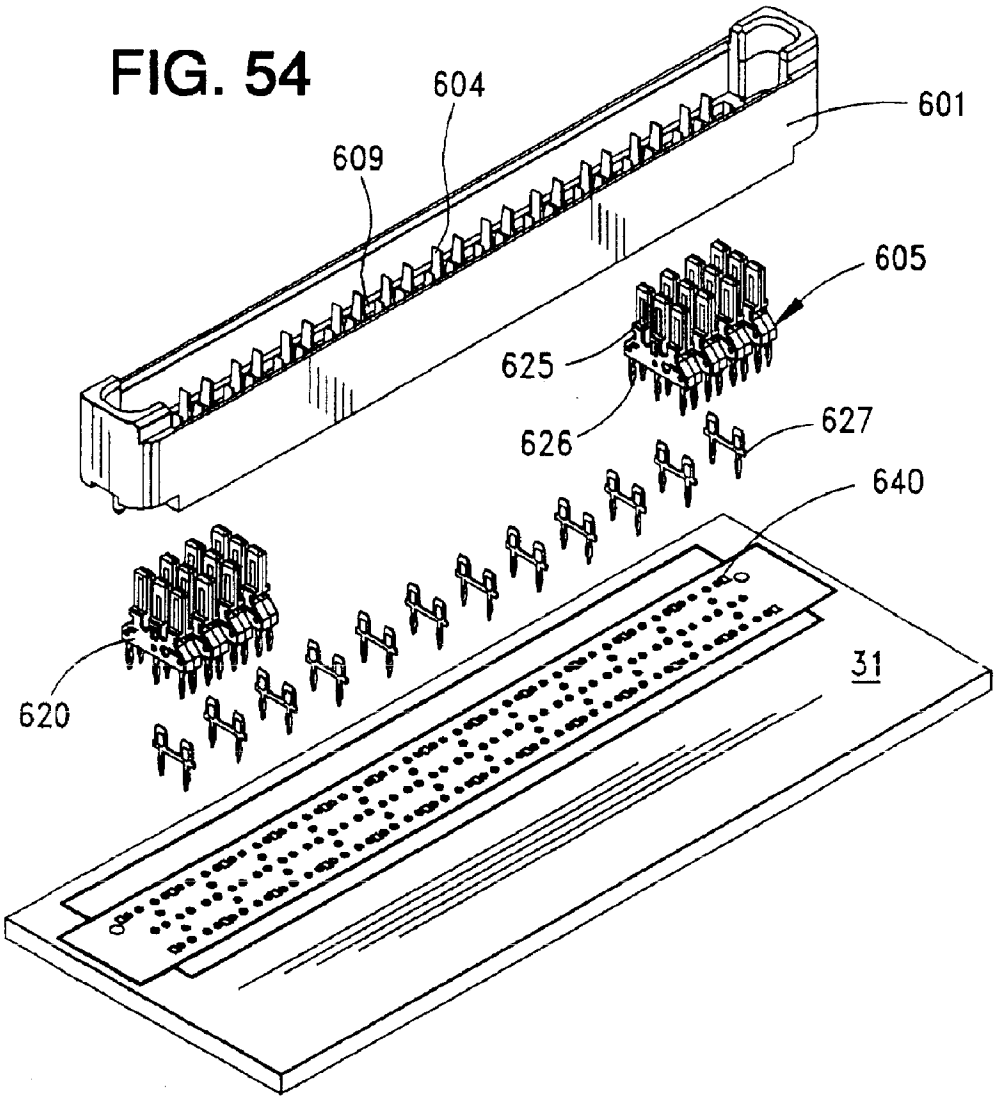
FIG. 54 is an exploded view of FIG. 53.

FIGS. 53–55 illustrate another embodiment on the invention 600 which uses a single receptacle member 601 that is constructed for vertical orientation on a circuit board 31 and which is also preferably used for differential signal applications. The receptacle member includes an insulative housing formed as a single piece and is provided with a central opening 603 that receives a plurality of terminal assemblies 605 therein, arranged in internal cavities 609 as described in the other embodiments. The receptacle member 601 has one or more engagement holes 602 arranged at opposite ends thereof that receive the blind-mate or position assurance engagement plugs 70 of the corresponding plug member 60. As shown in FIG. 54, the terminal assemblies 605 are arranged adjacent each other and they have base portions 620 which are received with the receptacle cavities 609. The connector 601 also includes a plurality of individual ground terminals 627 of the type shown and described hereinabove which are received in slots (not shown) in the bottom face of the connector 601 and which are arranged so as to separate the differential signal terminals into discrete groups. Both the ground terminal and signal terminal tail portions are received within corresponding holes, or vias 640, that are formed in the circuit board 31.

The terminal assemblies 605 include an insulative support frame, as illustrated best in FIG. 55, which supports one or more differential signal pairs of terminals having contact portions 625 which are supported on opposing surfaces of the free ends of the terminal assemblies 605 and tail portion 626 which extend out of the base portions 620, and which are shown as having compliant, eye-of-needle shapes. Slots 631 are formed in the terminal assemblies which serve to separate the pairs of differential signal terminals. Openings 632 may be formed in the terminal assembly body portions which communicate with and expose portions of the terminal body portions to air for the purposes of providing areas adjoining the terminals which have an dielectric constant of almost 1.0. These openings will face the inner walls of the receptacle connector 601 (not shown) in the same manner as described above for the other embodiments. The exterior surfaces of these receptacle connector 601 are also preferably plated with a conductive material so that each differential signal terminal pair will have a reference ground surrounding it. The terminal assemblies may be formed from two interengaging halves that utilize openings 634 and posts 635 to hold the assemblies together.

Figure 56:
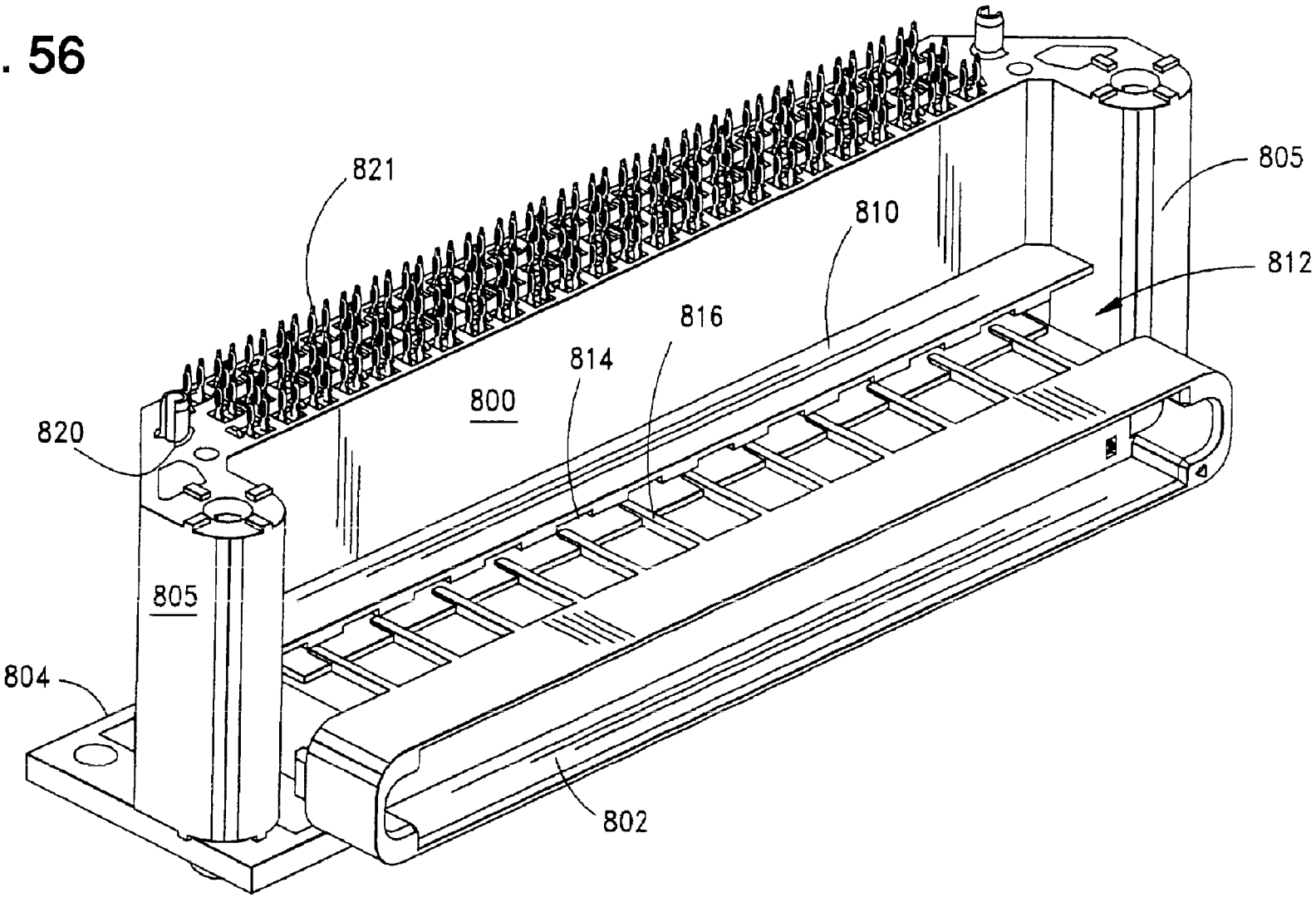
FIG. 56 is a perspective view of another embodiment of the invention, illustrating a combined docking and interposer connector structure.
Figure 58:
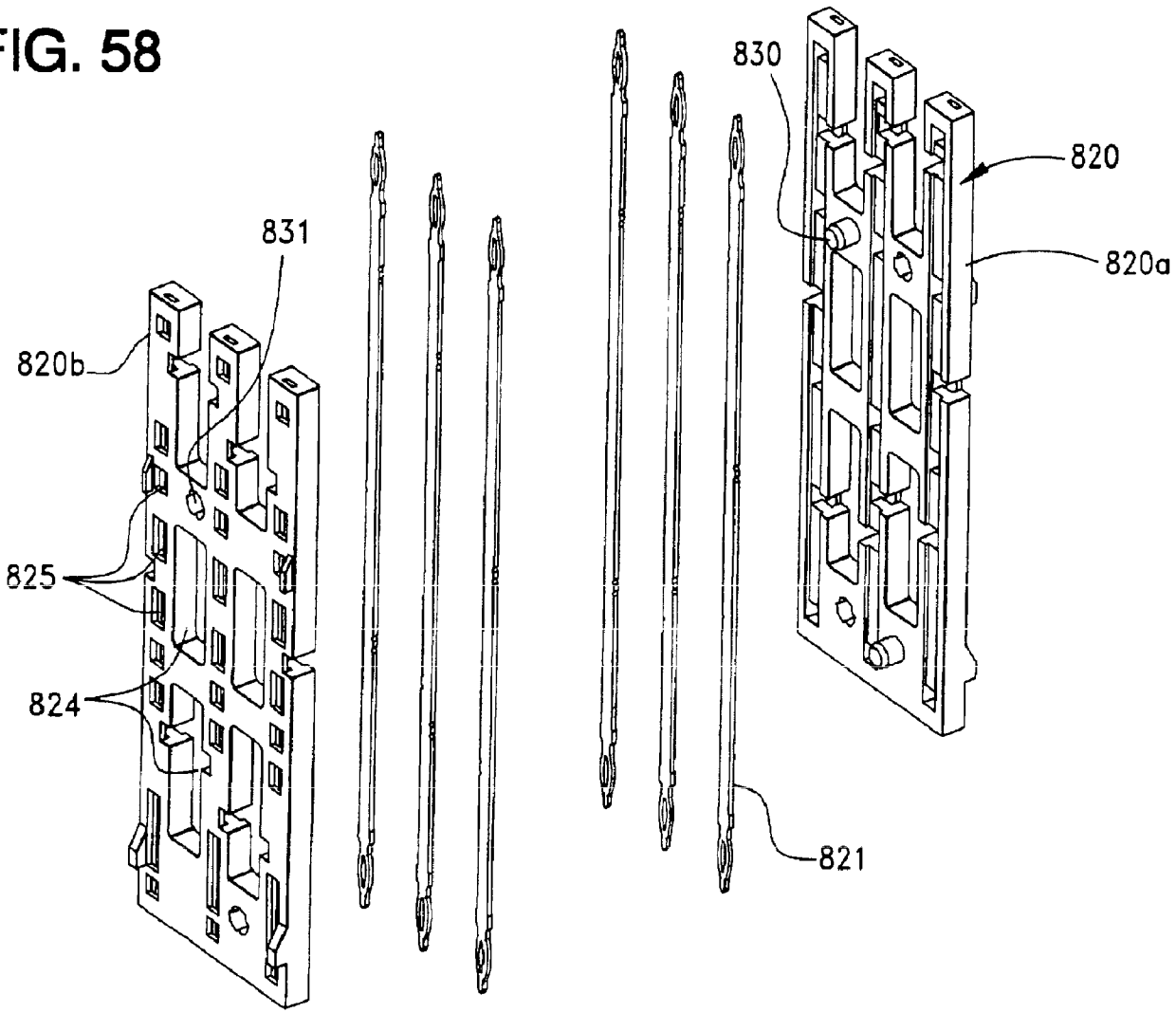
FIG. 58 is an exploded view of a terminal assembly utilized in the connector of FIG. 56; and, FIG. 59 is a perspective view of another embodiment of the connector assembly of FIG. 56.

FIG. 56 illustrates another embodiment of an interposer style connector having a housing 800 with its exterior surfaces plated with a conductive material, a plurality of cavities formed therein which extend between opposing sides of the connector housing 800 and which receive a plurality of terminal assemblies 820 formed from two insulative dielectric support halves 820*a*, 820*b* and which support conductive terminals 821. These terminal assemblies also include one or more slots 824 that separate differential signal terminal pairs, and openings 825 that expose the surface of the terminals 821 to air within the housing cavities. (FIG. 58.)

Figure 57:
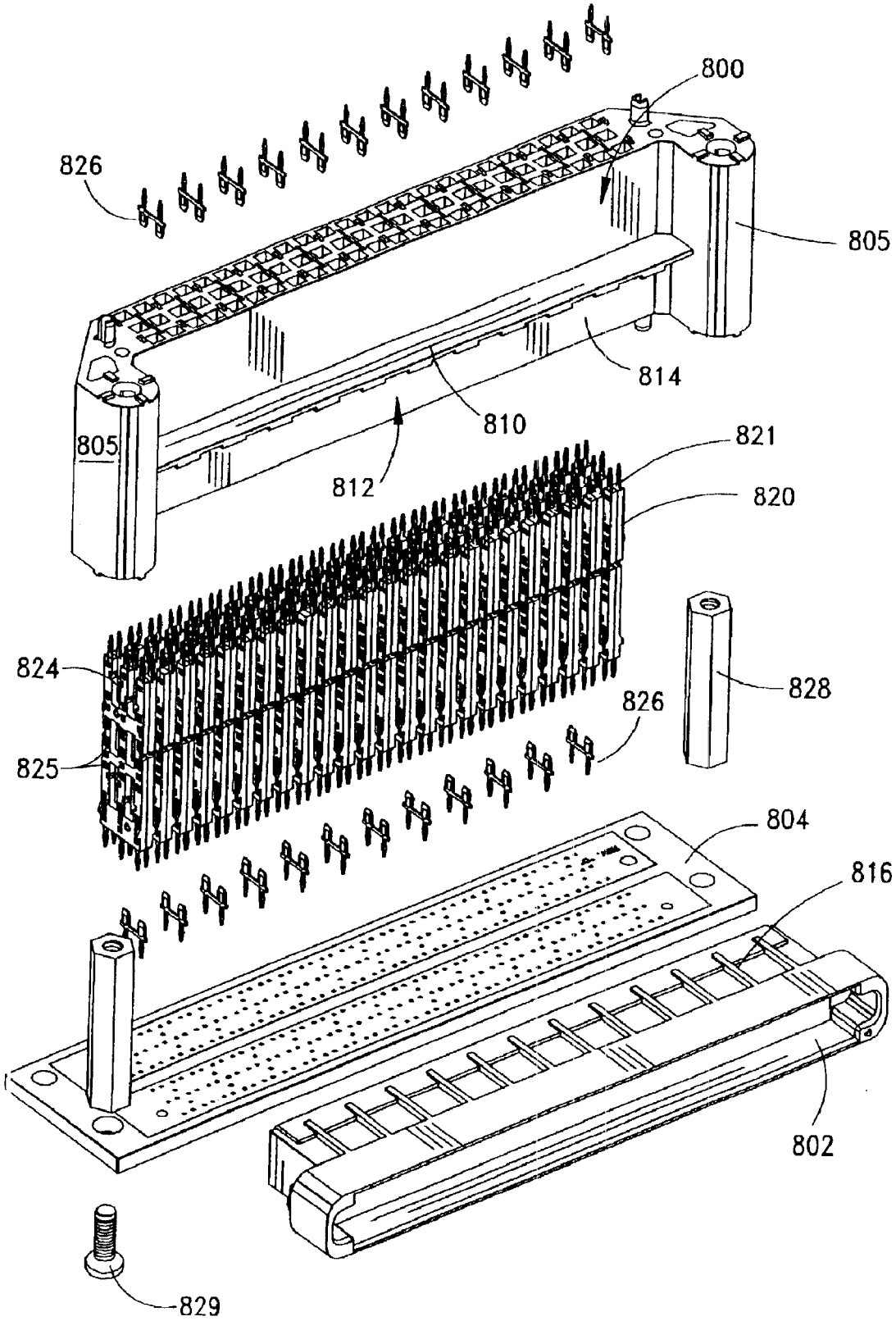
FIG. 57 is an exploded view of FIG. 56.
Figure 59:
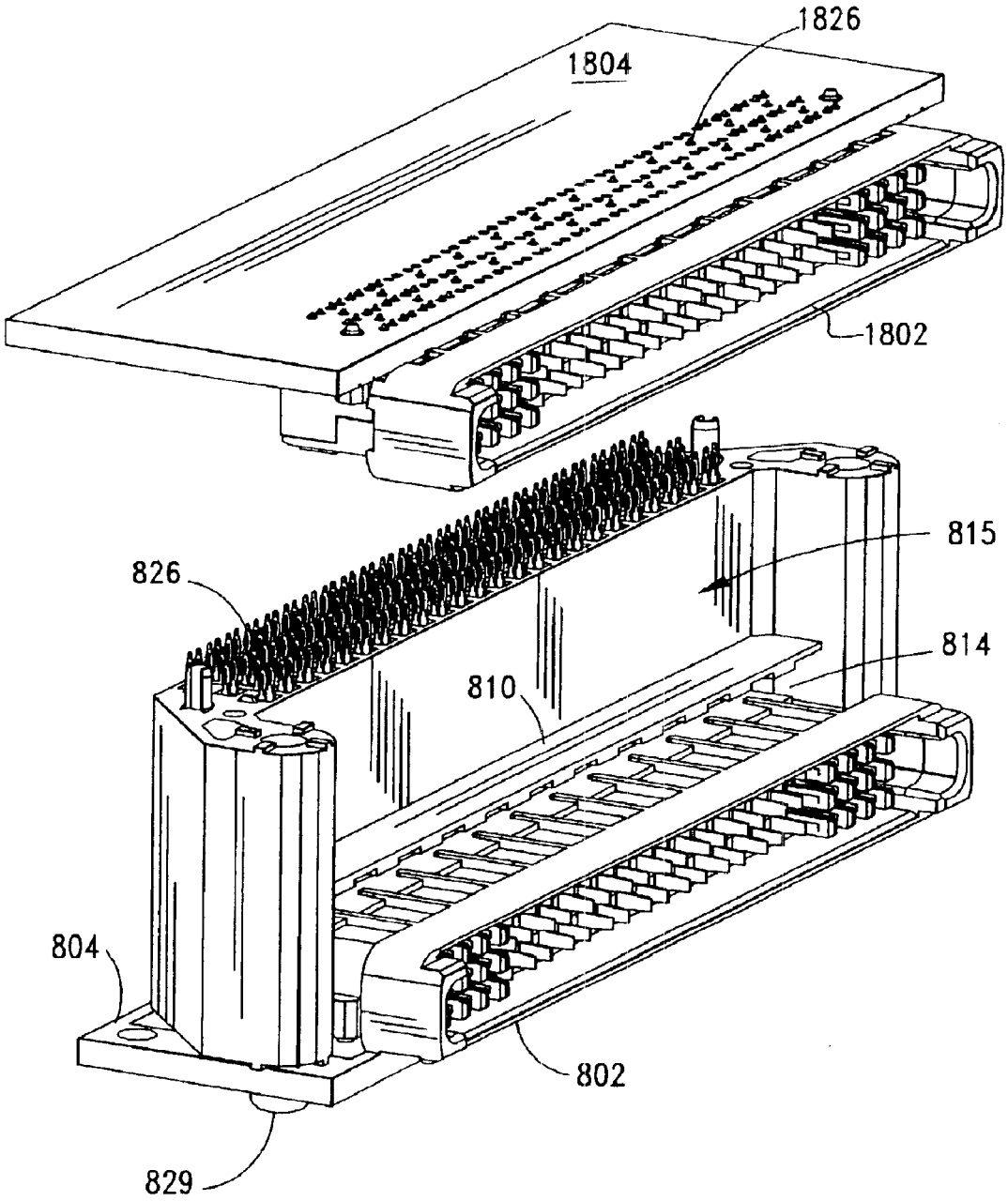

The housing 800 is shown to include two enlarged ends 805 which house mounting means that will typically include a nut 828, which, in association with a screw 829, the connector housing 800 may be secured to a circuit board 804. A web 810 is also preferably formed as part of the connector housing 800 that extends lengthwise between the enlarged ends 805. This web 810 not only subdivides the housing 800 into top and bottom 815, 814 spaces but also serves to prevent the ends 805 from bowing out of alignment during the manufacturing thereof, typically injection molding. These spaces 815, 814 may be considered as nests which may accommodate other similar connectors, such as the docking receptacle connector 802 shown in FIGS. 57 and 59. The web may be slotted to accommodate the ribs or other projections on the connector 802. A second connector 1802 may be mounted to a circuit board 1804 that is attached to the top mating face of the connector housing 800 so that its docking receptacle connector 1802 will be accommodated in the nest or space 815 above the web 810.

It will be understood that the various embodiments of the invention permit a plurality of differential signal pairs to have their impedance tuned by virtue of the terminal assemblies of the invention and to be significantly electrically isolated from each other by the conductive outer surfaces of the connectors of the invention. The use of the interstitial grounds of the invention improve speed in the interface with the circuit board and the compliant pin mounting aspect which may also be used in non differential signal applications, will improve the reliability of mating and permit the connectors to be removed and repaired, if necessary.

While the preferred embodiment of the invention have been shown and described, it will be apparent to those skilled in the art that changes and modifications may be made therein without departing from the spirit of the invention, the scope of which is defined by the appended claims.

What is claimed is:

1. A connector that provides improved electrostatic shielding by providing multiple ground connections between a connector plug half and a connector receptacle half before establishing a signal connection, each of the plug and receptacle halves including an upper housing portion having a plurality of passages arranged in rows and columns, each passages capable of accepting therein, a pair of differential signal conductors, said first upper housing portion being sized and shaped to be able to accept a mating second portion, a lower housing portion having a plurality of passages coupled to and substantially orthogonal to the passages of said upper housing portion;

said passages of both said upper and lower housings receiving therein a plurality of differential signal conductors which are electrically isolated from said upper and lower housing portions, the differential signal conductors in said upper housing portions extending at least partially out from said upper housing portions;

outer surfaces of said upper housings of said plug and receptacle halves being electrically conductive to provide a reference potential for said differential signal conductors and having multiple means for contacting each other, the contact means extending outward from said upper housing portions for a greater extent than said differential signal conductors whereby said conductive surfaces of said upper housings contact each other prior to said differential signal conductors contacting each other when said plug and receptacle halves are mated together.

2. The connector of claim 1, wherein said multiple contact means includes at least a pair of cantilevered contact arms that extend out from one of said plug and receptacle halves, the contact arms having contact points that are disposed forwardly of any of said differential signal conductors.

3. The connector of claim 2, wherein said plug and receptacle halves includes a pair of engagement plugs and said contact arms extend out from the engagement plugs.

4. The connector of claim 3, wherein said receptacle half includes a pair of engagement holes aligned with said engagement plugs, and said contact arm contact points extend into contact with interior surfaces of said receptacle engagement holes prior to any of said differential signal conductors of said connector making contact.

5. The connector of claim 3, wherein each engagement plug has a pair of contact arms extending outwardly therefrom.

6. The connector of claim 5, wherein said contact arms extend outwardly from opposite sides of said engagement plugs.

7. The connector of claim 2, wherein said multiple contact means further includes two interengaging shroud portions that at least partially enclose mating faces of said plug and receptacle halves, the shroud portions extending forwardly from the mating faces for a greater extent than said differential signal conductors.

8. The connector of claim 2, wherein said multiple contact means further includes a plurality of contact members integrally formed with one of said plug and receptacle halves, the contact members arranged in vertical columns and spaced apart from each other by a preselected spacing to define a gap between adjacent contact members, said gap receiving walls of said other of said plug and receptacle halves therein.

9. The connector of claim 7, wherein said multiple contact means further includes a plurality of contact members integrally formed with one of said plug and receptacle halves, the contact members arranged in vertical columns and spaced apart from each other by a preselected spacing to define a gap between adjacent contact members, said gap receiving vertical walls of said other of said plug and receptacle halves therein.

10. The connector of claim 7, wherein said differential signal conductors have a first predetermined length and said contact arm contact points are disposed on said plug mating halves at a first location and said shroud portions have a second predetermined length to sequentially establish first and second ground connections between said plug and receptacle halves prior to establishing contact between said differential signal conductors.

11. A differential signal connector assembly for transmitting differential signals between two electronic components and having improved grounding capability, the connector assembly comprising:

first and second connector housings, the first and second connector housings having a plurality of exterior surfaces, all of which are plated with a conductive surface such that said exterior surfaces conduct electricity;

a plurality of differential signal terminals supported in said first and second housings in opposing and interengaging pairs of differential signal terminals, the terminal pairs being supported by insulative support members and having contact portions which extend a preselected first length from respective mating faces of said first and second connector housings;

and, multiple means formed in said first and second connector housings for contacting each other before said differential signal conductors of said first and second connector housings make contact when said first and second connector said first and second connector housings are mated together.

12. The connector assembly of claim 11, wherein said contact means includes at least one contact arm extending from said first connector housing exterior surface into interference contact with said second connector housing exterior surface, the contact arm being located at a location on said first connector housing which is forward of said first length.

13. The connector assembly of claim 11, wherein said contact meas includes a shroud formed on said second connector housing that projects past a mating face and said differential signal conductors thereof and said first connector includes a wall that engages said shroud prior to said differential signal conductors making contact.

* * * * *